US008032041B2

(12) United States Patent
Atsumi et al.

(10) Patent No.: US 8,032,041 B2
(45) Date of Patent: Oct. 4, 2011

(54) IMAGE FORMING APPARATUS

(75) Inventors: Hidetoshi Atsumi, Nara (JP); Junko Yabuta, Nara (JP); Tatsuya Inoue, Nara (JP); Yoshiharu Yoneda, Nara (JP); Shinji Nakazawa, Kyoto (JP); Shuhji Fujii, Kyoto (JP); Atsushi Ogo, Nara (JP); Fuminori Miyoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1071 days.

(21) Appl. No.: 11/892,864

(22) Filed: Aug. 28, 2007

(65) Prior Publication Data

US 2008/0054555 A1 Mar. 6, 2008

(30) Foreign Application Priority Data

Aug. 29, 2006 (JP) ..... 2006-232568
Mar. 7, 2007 (JP) ..... 2007-057393

(51) Int. Cl.
*G03G 15/043* (2006.01)

(52) U.S. Cl. ..... 399/51

(58) Field of Classification Search ..... 399/51, 399/193, 195, 205; 347/234, 248
See application file for complete search history.

(56) References Cited

U.S. PATENT DOCUMENTS

| | | | | |
|---|---|---|---|---|
| 6,799,761 | B2 * | 10/2004 | Kato | 271/242 |
| 6,987,709 | B2 * | 1/2006 | Phillips | 368/46 |
| 2001/0053300 | A1 * | 12/2001 | Endo et al. | 399/394 |

FOREIGN PATENT DOCUMENTS

| | | | | |
|---|---|---|---|---|
| JP | 09219776 | A | * | 8/1997 |
| JP | 2002-014500 | A | | 1/2002 |
| JP | 2003248410 | A | * | 9/2003 |
| JP | 2003-330334 | A | | 11/2003 |
| JP | 2004-90284 | A | | 3/2004 |

OTHER PUBLICATIONS

Machine Translation of JP 09219776 A.*

* cited by examiner

*Primary Examiner* — David Gray
*Assistant Examiner* — Gregory H Curran
(74) *Attorney, Agent, or Firm* — Birch, Stewart, Kolasch & Birch, LLP

(57) ABSTRACT

A pair of registration rollers are provided upstream in a paper transport path from an image forming position, and a paper transport position detection portion is provided upstream in the paper transport path from the pair of registration rollers. When consecutive print processing on a plurality of sheets of paper is performed, a paper transport position in the paper transport path is detected by the paper transport position detection portion for a sheet of paper that has been set in advance among the plurality of sheets of paper. A correction amount of a position for image writing to a photosensitive drum is determined based on the paper transport position, and correction of the image writing position is performed based on the correction amount. Image forming on the sheet of paper is performed at the image forming position based on the image writing position after correction, and image forming on other sheets of paper after the sheet of paper that was set in advance is performed at the image forming position based on the image writing position after correction.

20 Claims, 19 Drawing Sheets

IMAGE FORMING APPARATUS

BACKGROUND OF THE INVENTION

This application claims priority on Japanese Patent Application No. 2006-232568 filed in Japan on Aug. 29, 2006, and Japanese Patent Application No. 2007-057393 filed in Japan on Mar. 7, 2007, the entire contents of which are hereby incorporated by reference.

The present invention relates to an image forming apparatus, and more specifically relates to an image forming apparatus compatible with a high speed device that transports more than 100 sheets per minute to a transfer portion.

In recent image forming apparatuses, space-saving vertical transport-type image forming apparatuses have become mainstream in order to reduce installation space. More specifically, this sort of apparatus has a structure in which a plurality of paper feed cassettes are disposed at multiple levels in the lower portion of the apparatus body, and a transfer portion and a fixing portion are disposed in the upper portion of the apparatus body. With such a structure, transport paper fed from a paper feed cassette is temporarily transported upward, then curved about 90 degrees at the front of the transfer portion to change to transport in the horizontal direction, and then transported toward the transfer portion.

FIG. 22A shows the configuration of a paper transport path at the front side of a transfer portion.

In a paper transport path 28 disposed in a curved shape as described above, pairs of transport rollers R31 and R32, pre-registration rollers R41 and R42, and registration rollers R51 and R52 are disposed in order in a paper transport direction S. The registration rollers R51 and R52, at a distance of about 50 mm, face a nip portion N1, which is a contact portion of an electrostatic latent image carrier (a photosensitive drum) 14 and a transfer roller 17*a*.

FIG. 23 is a chart that shows the operation timing of the registration rollers R51 and R52 and the pre-registration rollers R41 and R42.

When paper P is transported through the paper transport path 28 to the registration rollers R51 and R52, and the leading edge of the paper makes contact with a nip portion N5 of the registration rollers R51 and R52, first the registration rollers R51 and R52 stop at a time t1, and the pre-registration rollers R41 and R42 stop at a time t2 that is slightly after the time t1. Due to stoppage according to this time difference, the paper P being held sandwiched by the registration rollers R51 and R52 and the pre-registration rollers R41 and R42 is kept in a state bowed in a slight curve, as shown in FIG. 22A.

Afterward, at a timing t3 when an image forming position (for example, the leading edge) of the paper P is caused to coincide with an image writing position (for example, the leading edge) of image information that has been made visible on the photosensitive drum 14, the registration rollers R51 and R52 and the pre-registration rollers R41 and R42 start transport of the paper P again. At this time, because the paper P is slightly bowed, the feed-out timing of the leading edge of the paper P from the registration rollers R51 and R52 can be made uniform in the widthwise direction of the paper. Thus tilting of the paper P is prevented, eliminating distortion of the formed image in the widthwise direction of the paper P. More specifically, with respect to paper P that has been temporarily stopped by the registration rollers R51 and R52, during this stoppage, fine adjustment of the paper transport position (for example, the position of the leading edge) in a direction parallel to a paper transport direction S, adjustment of the center position of the paper P in the transport path (see paper transport direction S) during transport, and tilting of the paper P in the transport path (see paper transport direction S) during transport, and the like are corrected by the registration rollers R51 and R52.

Incidentally, in recent image forming apparatuses, accelerated print processing speed relative to conventional image forming apparatuses has been sought. For example, conventionally, an image forming apparatus capable of 60 sheets per minute (in the case of A4 sideways transport) or greater was deemed to be a high speed device, but recently, an image forming apparatus capable of 80 sheets per minute or greater is referred to as a high speed device, and moreover, development of image forming apparatuses capable of not less than 100 to 120 sheets per minute is progressing.

In this sort of image forming apparatus, it is necessary to achieve an improvement in print quality when transferring a toner image on a photosensitive drum onto paper. An important factor for insuring this print quality is increasing the precision of matching the image writing position of the image information that has been made visible on the photosensitive drum 14 with the image forming position of the paper P stopped by the registration rollers R51 and R52.

As technology for improving the precision of position-matching in this manner, a paper transport apparatus is proposed in JP 2003-248410A and JP 2003-330334A.

JP 2003-248410A discloses an apparatus that detects a length of displacement in a direction perpendicular to the paper transport direction, and performs control so as to correct the image writing position. JP 2003-330334A discloses an apparatus that detects a length of displacement in a direction perpendicular to the paper transport direction, and performs control so as to continue image forming when that displacement length does not exceed a prescribed value, and temporarily stop paper transport when that displacement length exceeds the prescribed value.

However, in recent high speed devices, due to acceleration of the paper transport speed, during consecutive printing of a plurality of sheets, adjustment of paper transported subsequent to the first sheet is difficult to perform in a timely manner. More specifically, with respect to the first sheet of printing, there is time to spare in the initialization process of the apparatus, so by making the timing for feed of paper from a paper feed portion earlier, it is possible to insure time to spare for adjustment of the image writing position. However, the timing for transport of the second and subsequent sheets of paper depends on the print processing speed, i.e., the transport speed, and so before the leading edge of the second and subsequent sheets of paper makes contact with the nip portion of the registration rollers, writing of image information onto the photosensitive drum has started, and therefore no time to spare is available for adjusting the desired position on the paper where an image will be formed.

Consequently, in order to address the problems described above, it is an object of the present invention to provide an image forming apparatus in which a desired image forming position on paper and a position of image writing to an image carrier can be matched together with good precision even in a high-speed device.

SUMMARY OF THE INVENTION

In order to attain the above object, the present invention provides an image forming apparatus that forms an image on paper, the image forming apparatus including an image carrier (for example, such as a photosensitive drum that is an electrostatic latent image carrier or an intermediate transfer belt that is a intermediate transfer body) that forms an image on paper at an image forming position provided in a paper transport path where paper is transported, a registration roller that performs transport and transport stoppage of paper to the image forming position, and a paper transport position detection portion that detects a paper transport position of paper in the paper transport path; in which the registration roller is provided upstream in the paper transport path from the image forming position, and the paper transport position detection portion is provided upstream in the paper transport path from the registration roller, and when performing consecutive print processing to a plurality of sheets of paper, the paper transport position in the paper transport path is detected by the paper transport position detection portion for a sheet of paper that has been set in advance among the plurality of sheets of paper, a correction amount of the position of image writing to the image carrier is determined based on the detected paper transport position, correction of the image writing position is performed based on the correction amount, image forming on paper is performed at the image forming position based on the image writing position after the correction, and image forming on other sheets of paper after the sheet of paper that was set in advance is performed at the image forming position based on the image writing position after the correction.

In the above configuration, when for example adopting a direct-transfer system, a configuration may be adopted in which when performing consecutive print processing to a plurality of sheets of paper, the paper transport position in the paper transport path is detected by the paper transport position detection portion for a sheet of paper that has been set in advance among the plurality of sheets of paper, a correction amount of the position of image writing to the image carrier is determined based on the detected paper transport position, correction of the image writing position is performed based on the correction amount, image forming is performed directly on paper by the image carrier at the image forming position based on the image writing position after the correction, and image forming on other sheets of paper after the sheet of paper that was set in advance is performed directly by the image carrier at the image forming position based on the image writing position after the correction.

Also, in the above configuration, when for example adopting an indirect-transfer system, a configuration may be adopted in which when performing consecutive print processing to a plurality of sheets of paper, the paper transport position in the paper transport path is detected by the paper transport position detection portion for a sheet of paper that has been set in advance among the plurality of sheets of paper, a correction amount of the position of image writing to the image carrier is determined based on the detected paper transport position, correction of the image writing position is performed based on the correction amount, image forming is performed indirectly on paper by the image carrier at the image forming position based on the image writing position after the correction, and image forming on other sheets of paper after the sheet of paper that was set in advance is performed indirectly by the image carrier at the image forming position based on the image writing position after the correction.

With the present invention as described above, the registration rollers are provided upstream in the paper transport path from the image forming position, and the paper transport position detection portion is provided upstream in the paper transport path from the registration rollers, and when performing consecutive print processing to a plurality of sheets of paper, the paper transport position in the paper transport path is detected by the paper transport position detection portion for a sheet of paper that has been set in advance among the plurality of sheets of paper, a correction amount of the position of image writing to the image carrier is determined based on the detected paper transport position, correction of the image writing position is performed based on the correction amount, image forming is performed directly or indirectly on paper by the image carrier at the image forming position based on the image writing position after the correction, and image forming on other sheets of paper after the sheet of paper that was set in advance is performed directly or indirectly by the image carrier at the image forming position based on the image writing position after the correction. Thus, the desired image forming position on the paper and the position of image writing to the image carrier can be matched together with good precision even in a high speed device. Also, with respect to the image forming position of the other sheets of paper, detection of the paper transport position by the paper transport position detection portion for a sheet of paper that has been set in advance is utilized, so even in a high speed device, image forming can be performed while correcting the image forming position of a plurality of sheets of paper. Also, even when detection of the paper transport position of other sheets of paper is performed by the paper transport position detection portion after image writing has started, correction of the image writing position for those other sheets of paper can be appropriately performed.

In the above configuration, the correction amount of the image writing position may be determined based on a displacement amount of the paper transport position of paper detected by the paper transport position detection portion relative to a paper transport position that has been set in advance in the paper transport path.

In this case, because the correction amount of the image writing position is determined based on a displacement amount of the paper transport position of paper detected by the paper transport position detection portion relative to a paper transport position that has been set in advance in the paper transport path, correction of the image writing position in a desired direction is possible, and as a result, this configuration is compatible with displacement of the paper transport position in the paper transport path in a desired direction.

In the above configuration, a configuration may be adopted in which the displacement amount is an off-center amount of the paper transport position of paper in a direction perpendicular to the transport direction in the paper transport path, and when performing consecutive print processing to a plurality of sheets of paper, the off-center amount in the paper transport path is measured by the paper transport position detection portion for the sheet of paper that has been set in advance, a correction amount of the position of image writing to the image carrier is determined based on the detected off-center amount, correction of the image writing position is performed based on the correction amount, image forming on paper is performed at the image forming position based on the image writing position after the correction, and image forming on the other paper is performed at the image forming position based on the image writing position after the correction.

In this case, because the displacement amount is an off-center amount of the paper transport position of paper in a direction perpendicular to the transport direction in the paper transport path, and when performing consecutive print processing to a plurality of sheets of paper, the off-center amount in the paper transport path is measured by the paper transport position detection portion for the sheet of paper that has been set in advance, a correction amount of the position of image writing to the image carrier is determined based on the detected off-center amount, correction of the image writing position is performed based on the correction amount, image forming on paper is performed at the image forming position based on the image writing position after the correction, and image forming on the other paper is performed at the image forming position based on the image writing position after the correction, this configuration is compatible with displacement of the paper transport position in the direction perpendicular to the transport direction of the paper transport path.

In the above configuration, a plurality of paper feed portions that transport paper to the image forming position may be provided upstream in the paper transport path from the registration roller, and correction of the image writing position performed independently for each of the plurality of paper feed portions.

In this case, because a plurality of paper feed portions that transport paper to the image forming position are provided upstream in the paper transport path from the registration roller, and correction of the image writing position is performed independently for each of the plurality of paper feed portions, regardless of the function of the plurality of paper feed functions, it is possible to perform correction of the image writing position while distinguishing between each of the plurality of paper feed portions. As a result, image forming to paper stored in the respective paper feed portions can be appropriately performed regardless of which paper feed portion is the source of the paper.

In the above configuration, when the paper feed portion has been changed when performing consecutive print processing to a plurality of sheets of paper, image forming processing of the apparatus may be initialized, and correction of the image writing position of paper transported from the paper feed portion performed for the paper feed portion after the change.

In this case, because when the paper feed portion has been changed when performing consecutive print processing to a plurality of sheets of paper, image forming processing of the apparatus is initialized, and correction of the image writing position of paper transported from the paper feed portion is performed for the paper feed portion after the change, it is possible to set the image forming position of the paper for each of the plurality of paper feed portions, and so it is possible to increase the precision of the image forming position of the paper independently for each of the paper feed portions.

In the above configuration, when the paper feed portion has been updated when performing consecutive print processing to a plurality of sheets of paper, image forming processing of the apparatus may be initialized, and correction of the image writing position of paper transported from the paper feed portion performed for the updated paper feed portion.

In this case, when the paper feed portion has been updated when performing consecutive print processing to a plurality of sheets of paper (in order to feed paper to the paper feed portion), image forming processing of the apparatus is initialized, and correction of the image writing position of paper transported from the paper feed portion performed for the updated paper feed portion, so even when the paper feed portion has been updated, displacement of the image forming position of the paper that accompanies updating is eliminated, and so it is possible to increase the precision of the image forming position of the paper independently for each of the paper feed portions.

In the above configuration, the correction amount of the image writing position may be measured for a plurality of sheets of paper that have been set in advance, transported from the same paper feed portion, and an average value of the correction amount of the plurality of sheets of paper used as the correction value of the image writing position.

In this case, because the correction amount of the image writing position is measured for a plurality of sheets of paper that have been set in advance, transported from the same paper feed portion, and an average value of the correction amount of the plurality of sheets of paper is used as the correction value of the image writing position, the correction amount of the image writing position corresponds to a plurality of sheets of paper, and so it is possible to increase the precision of matching the desired image forming position on the paper with the position for image writing on the image carrier. Also, the plurality of sheets of paper with which the correction amount corresponds are not limited to paper transported consecutively; this paper may be set as desired. For example, the paper with which the correction value corresponds may be set as desired to an odd or an even number of sheets of paper that skips one sheet, or from one to 10-30 sheets of paper, or two to eight sheets of paper, or the like.

In the above configuration, the correction value of the image writing position may be limited to a correction value within a range that has been set in advance, and a correction value outside of the range that has been set in advance excluded from data for the average value.

In this case, the correction value of the image writing position is limited to a correction value within a range that has been set in advance, and a correction value outside of the range that has been set in advance is excluded from data for the average value, so the precision of the data for the average value can be increased by not adopting data with low reliability in the data for the average value, and as a result, it is possible to increase the precision of the image forming position on the paper.

In the above configuration, the paper transport position detection portion may perform detection of the paper transport position in a state with paper stopped by the registration roller.

In this case, the paper transport position detection portion performs detection of the paper transport position in a state with paper stopped by the registration roller, so it is possible to detect the paper transport position in a state in which displacement of the paper transport in the paper transport path has been eliminated, and so it is possible to suppress displacement of the paper transport position due to displacement of the paper transport.

In the above configuration, the paper transport position detection portion may perform detection of the paper transport position in a state in which paper is transported by the registration roller. Specifically, in the above configuration, the paper transport position detection portion may perform detection of the paper transport position from a state in which the paper has been stopped by the registration roller, until paper transport by the registration roller ends. It is particularly preferable that the paper transport position detection portion detects one side edge in the direction perpendicular to the paper transport direction.

In this case, the paper transport position detection portion may perform detection of the paper transport position in a state in which paper is transported by the registration roller, so it is possible to detect the paper transport position in a state in which bowing of the paper in the paper transport path is eliminated, and so displacement of the paper transport position due to bowing of the paper can be suppressed.

In the above configuration, a configuration may be adopted in which a plurality of paper feed portions that transport paper to the image forming position are provided upstream in the paper transport path from the registration roller, and prior to consecutive print processing of a plurality of sheets of paper transported to the image forming position from a paper feed portion selected from among the plurality of paper feed portions in order to perform image writing, paper is transported from the selected paper feed portion to the image forming position.

In this case, because a plurality of paper feed portions that transport paper to the image forming position are provided upstream in the paper transport path from the registration roller, and prior to consecutive print processing of a plurality of sheets of paper transported to the image forming position from a paper feed portion selected from among the plurality of paper feed portions in order to perform image writing, paper is transported from the selected paper feed portion to the image forming position, the first sheet of paper can be more quickly fed when performing consecutive print processing to a plurality of sheets of paper.

Also, in the above configuration, when the paper feed portion has been updated, paper may be transported to the image writing position from the updated paper feed portion prior to the consecutive print processing.

In this case, when the paper feed portion has been updated (in order to feed paper to the paper feed portion), paper is transported to the image writing position from the updated paper feed portion prior to the consecutive print processing, so the first sheet of paper can be more quickly fed when performing consecutive print processing to a plurality of sheets of paper.

Also, in the above configuration, when the paper feed portion has been changed, paper transported to the image writing position prior to the consecutive print processing may be transported out of the image forming position.

In this case, when the paper feed portion has been changed, paper transported to the image writing position prior to the consecutive print processing is transported out of the image forming position, so it is possible to avoid printing to undesired paper in a state in which the first sheet of paper is more quickly fed when performing consecutive print processing to a plurality of sheets of paper.

Also, in the above configuration, after passage of a time set in advance, paper transported to the image writing position prior to the consecutive print processing may be transported out of the image forming position.

In this case, after passage of a time set in advance, paper transported to the image writing position prior to the consecutive print processing is transported out of the image forming position, so it is possible to avoid printing to undesired paper in a state in which the first sheet of paper is more quickly fed when performing consecutive print processing to a plurality of sheets of paper.

DESCRIPTION OF THE PREFERRED EMBODIMENTS

Hereinafter, embodiments of the present invention will be described in detail with reference to the accompanying drawings.

Embodiment 1

Figure 1:
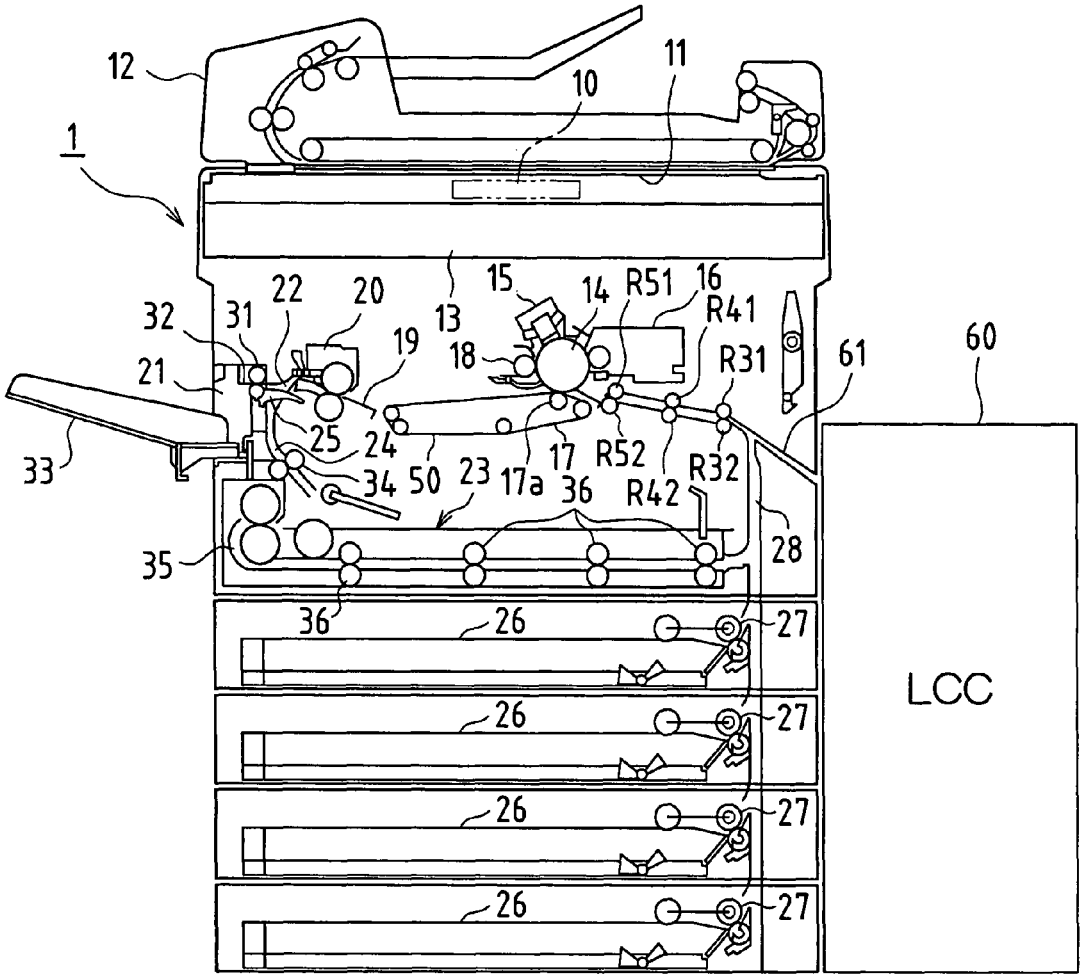
FIG. 1 is a schematic configuration view that shows the overall configuration of a direct transfer-type image forming apparatus according to the present embodiment.

FIG. 1 is a side view that shows the overall configuration of an image forming apparatus according to the present embodiment.

An image forming apparatus 1 of the present embodiment, for example, is a digital image forming apparatus having copy, printer, scanner, and facsimile modes, and is provided with an operation panel 10 on the front face side of the image forming apparatus 1.

An original stage 11, which is a body of hard translucent glass, is disposed on an upper face of the image forming apparatus 1. An automatic original feeding apparatus 12 is disposed above the original stage 11, and an optical unit 13 is disposed below the original stage 11.

An image forming system that forms an image on paper is provided below the optical unit 13, and in this image forming system, a photosensitive drum 14 (image carrier) is rotatably supported. The photosensitive drum 14 is an electrostatic latent image carrier whose surface is configured from photoconductive material. A charging unit 15, a development unit 16, a transfer unit 17 and a cleaner 18 are disposed around the periphery of the photosensitive drum 14, in a state face facing the circumferential face of the photosensitive drum 14.

In the image forming apparatus 1 with the above configuration, when start of an image forming process is instructed by operation of the operation panel 10, the optical unit 13 scans an image face of an original that has been placed on the original stage 11, and of light from a copy lamp in the optical unit 13, reflected light on the original image face is irradiated to the surface of the photosensitive drum 14.

The surface of the photosensitive drum 14 is uniformly charged to a charge of a single polarity by the charging unit 15 prior to irradiation of reflected light from the original, and an electrostatic latent image is formed on the surface of the photosensitive drum 14 by a photoconductive action provided by the irradiation of the reflected light from the original. Toner is fed from the development unit 16 to the surface of the photosensitive drum 14 on which the electrostatic latent image has been formed, and thus the electrostatic latent image is converted to a visible toner image.

A fixing unit 20 composed of a hot roller and a pressure roller is disposed on the downstream side of the photosensitive drum 14. A transfer belt 50 of the aforementioned fixing unit 17 and a paper guide 19 are disposed between the fixing unit 20 and the photosensitive drum 14, and a paper fixing transport path from the photosensitive drum 14 to the fixing unit 20 is formed by the transfer belt 50 and the paper guide 19.

A discharge tray 33 is provided in a side face of the image forming apparatus 1, and a discharge transport path 22 is formed between the fixing unit 20 and the discharge tray 33. A portion of the discharge transport path 22 branches to a re-transport path 24 that continues to an automatic duplex paper feed apparatus 23 disposed below the photosensitive drum 14 via a branch gate 25.

Figure 22A:
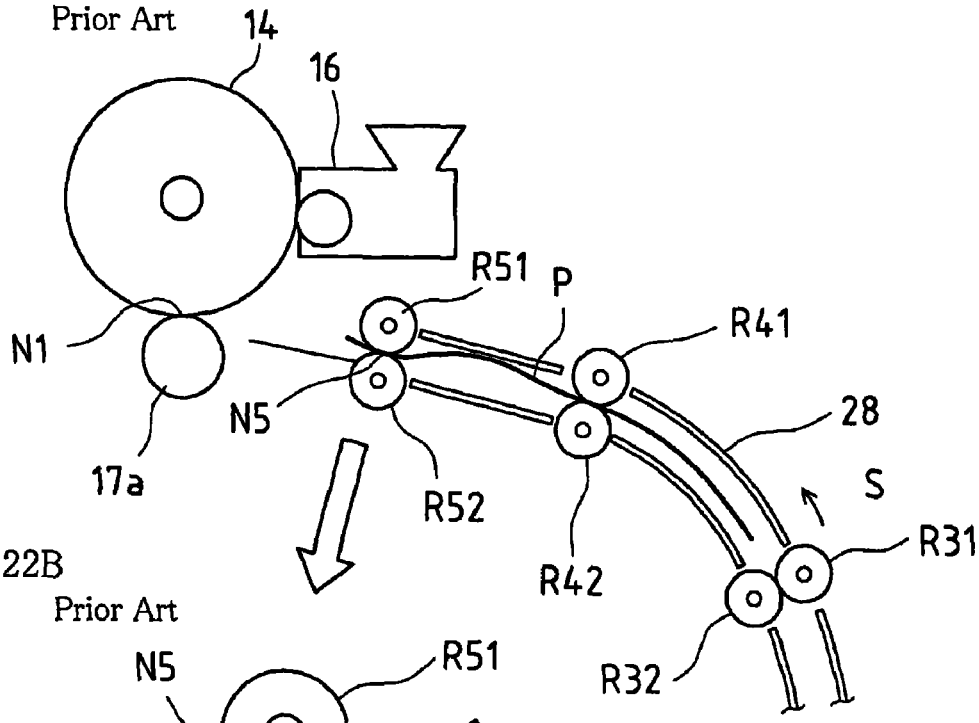
FIG.22A Prior Art
FIG. 22A is an explanatory diagram that shows the configuration of a paper transport path at the front side of a transfer portion.
Figure 22B:
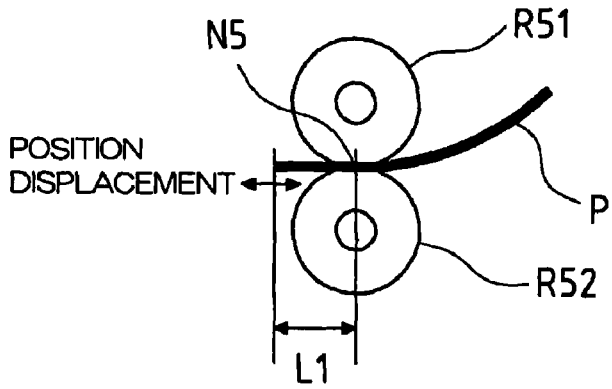
FIG.22B Prior Art
FIG. 22B is an explanatory diagram that shows an enlarged view of a registration roller portion.
Figure 23:
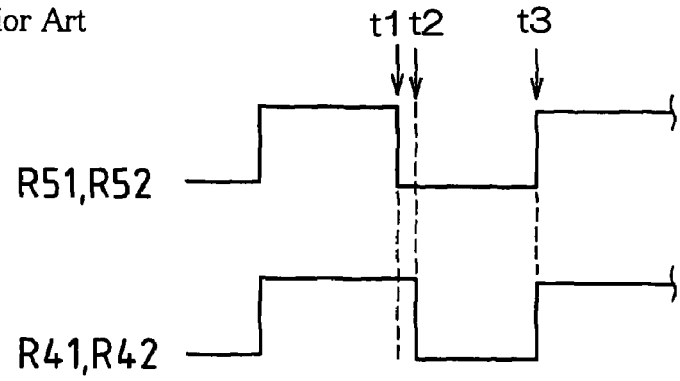
FIG.23 Prior Art
FIG. 23 is a chart that shows the operation timing of registration rollers and pre-registration rollers.

Four paper feed cassettes 26 removably installed from a front face side of the image forming apparatus 1 are provided in a lower portion of the image forming apparatus 1. Each of the paper feed cassettes 26 stores paper of a different size, and prior to rotation of the photosensitive drum 14, paper from any one of the four paper feed cassettes 26 is fed via a paper feed roller 27. The fed paper is transported in the direction of the photosensitive drum 14 by transport rollers R31 and R32 via a shared transport path 28, and stopped with the trailing edge of that paper held sandwiched by pre-registration rollers R41 and R42, and the leading edge of the paper making contact with registration rollers R51 and R52. The configuration of this portion is the same as the configuration shown in FIG. 22. Also, the operation timing of the registration rollers R51 and R52 and the pre-registration rollers R41 and R42 is the same as the operation timing shown in FIG. 23. Transport and transport stoppage of paper in a paper transport path (see paper transport direction S), in which the paper is transported to an image forming position (see a nip portion N1 shown in FIG. 2) by the photosensitive drum 14 described below, are performed by the registration rollers R51 and R52.

Also, the image forming apparatus 1 of the present embodiment is provided with a large capacity paper feed cassette (LCC) 60. A detailed description of the structure of the large capacity paper feed cassette 60 is omitted. Paper fed from the large capacity paper feed cassette 60 via a unit side transport path 61 that merges with the shared transport path 28 at the front side of the transport rollers R31 and R32 is transported in the direction of the photosensitive drum 14 by the transport rollers R31 and R32, and that paper is stopped with the trailing edge of the paper held sandwiched by the pre-registration rollers R41 and R42, and the leading edge of the paper making contact with registration rollers R51 and R52.

Also, as described above, the paper transport path in the image forming apparatus 1 of the present embodiment is configured from a paper fixing transport path, the discharge transport path 22, the re-transport path 24, the shared transport path 28, and the unit side transport path 61.

The registration rollers R51 and R52 rotate in synchronization with rotation of the photosensitive drum 14, thus guiding paper to the nip portion (image forming region) N1 between the photosensitive drum 14 and the transfer unit 17. Paper that has been guided to a desired image forming position of the image forming region receives a corona discharge of the transfer unit 17, and the toner image carried on the surface of the photosensitive drum 14 is transferred to the surface of the paper.

The paper onto which a toner image has been transferred is transported along the transfer belt 50 and the paper guide 19 to the fixing unit 20, and receives heat and pressure in the fixing unit 20. Thus, the toner image is fixed by melting onto the surface of the paper.

In a simplex printing mode in which an image is printed on one face of paper, paper that has passed through the fixing unit 20 is discharged onto the discharge tray 33 from a discharge opening 32 by a discharge roller 31 via the discharge transport path 22. At this time, the discharge roller 31 is driven back and forth in the paper transport direction by an unshown discharge roller drive portion.

In a duplex printing mode in which an image is printed on both faces of paper, the branch gate 25 is exposed in a portion of the discharge transport path 22, and paper that has passed through the fixing unit 20 is transported to the automatic duplex paper feed apparatus 23 via the re-transport path 24, which is provided with a transport roller 34. Paper that has been transported to the automatic duplex paper feed apparatus 23 is fed in a state in which the leading and trailing edges of the paper have been reversed by a re-feed roller 35, and is again transported via the shared transport path 28 in the direction of the photosensitive drum 14 in a state in which the front and back faces of the paper have been reversed by a re-transport roller 36. That paper is stopped with the leading edge of the paper making contact with the registration rollers R51 and R52, and the trailing edge of the paper held sandwiched by the pre-registration rollers R41 and R42.

Figure 2A:
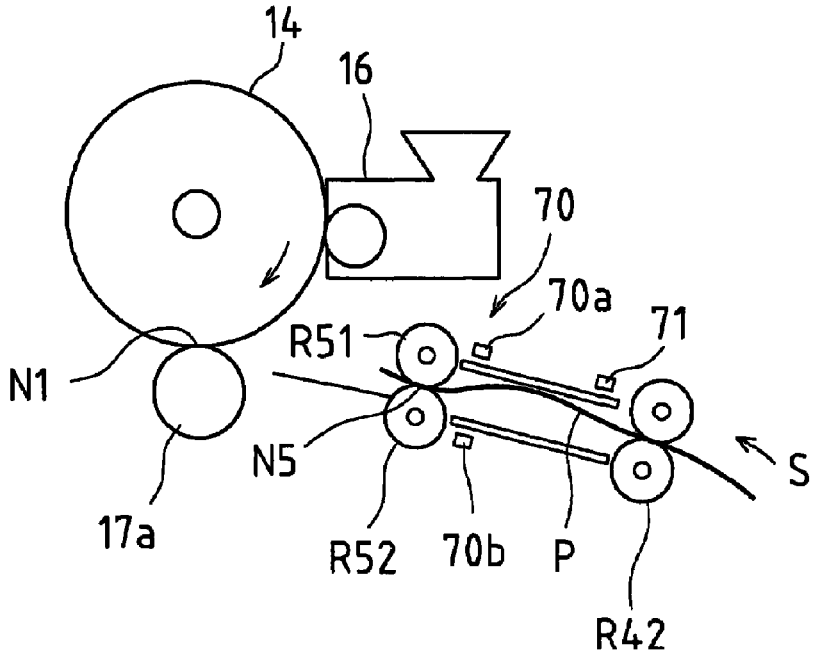
FIG. 2A is a schematic side view of a paper transport position detection portion according to the present embodiment.
Figure 2B:
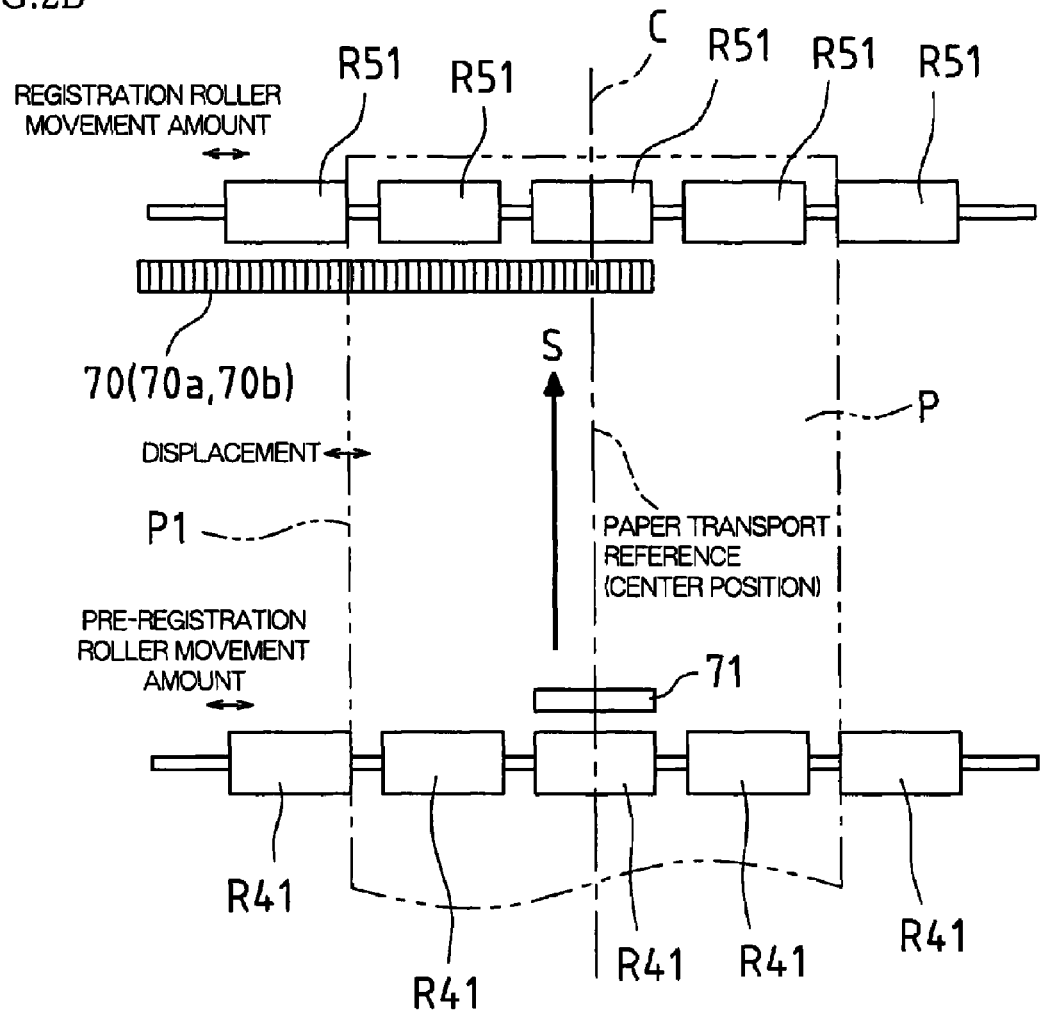
FIG. 2B is a schematic plan view of the paper transport position detection portion according to the present embodiment.

FIGS. 2A and 2B show an example configuration of a paper transport position detection portion 70 and a paper detection portion 71. In a state in which the paper is in a state stopped and held sandwiched by the registration rollers R51 and R52, and the pre-registration rollers R41 and R42, the paper transport position detection portion 70 detects the paper transport position of paper P in the paper transport path (a displacement amount (off-center amount) of the paper from a paper transport reference (center position) that has been set in advance in a direction perpendicular to the transport direction of the paper transport path), and the paper detection portion 71 detects the paper.

As shown in FIGS. 2A and 2B, the registration rollers R51 and R52 are provided upstream in the paper transport path from the image forming position (see the nip portion N1). As shown in FIGS. 2A and 2B, the pre-registration rollers R41 and R42 are provided upstream in the paper transport path from the paper transport position detection portion 70 and the paper detection portion 71. Also, as shown in FIG. 2B, five sets of the registration rollers R51 and R52 and the pre-registration rollers R41 and R42 respectively are disposed at a predetermined interval in the left-right direction (the direction perpendicular to the paper transport direction), with the paper transport position detection portion 70 disposed near the registration rollers R51 and R52, and the paper detection portion 71 disposed near the registration rollers R41 and R42. More specifically, a light emitting portion 70*a* and a light receiving portion 70*b* of a line sensor used to configure the paper transport position detection portion 70 vertically oppose each other via the paper transport path (FIG. 2A), and are disposed in the left-right direction along the registration rollers R51 and R52 (FIG. 2B). The paper transport position detection portion 70 disposed in this manner is formed with a length compatible with being able to detect one side edge P1 of the paper P for minimum (for example, postcard size) to maximum (for example, A3 portrait size) widths of the transported paper P.

Also, in the image forming apparatus 1 with the above configuration, a plurality of paper feed portions that transport paper (feed paper) to the image forming position (see nip portion N1) are provided upstream in the paper transport path from the registration rollers R51 and R52. The paper feed portion referred to here may be any constituent member that transports paper to the image forming position (see the Nip portion N1), specific examples of which are the automatic duplex paper feed apparatus 23, the paper feed cassettes 26 and the LCC 60. Also note that a feed portion according to the present embodiment is not limited to the automatic duplex paper feed apparatus 23, the paper feed cassettes 26 and the LCC 60; another feed portion that feeds paper such as a manual paper feed cassette, for example, may also be used.

Figure 3:
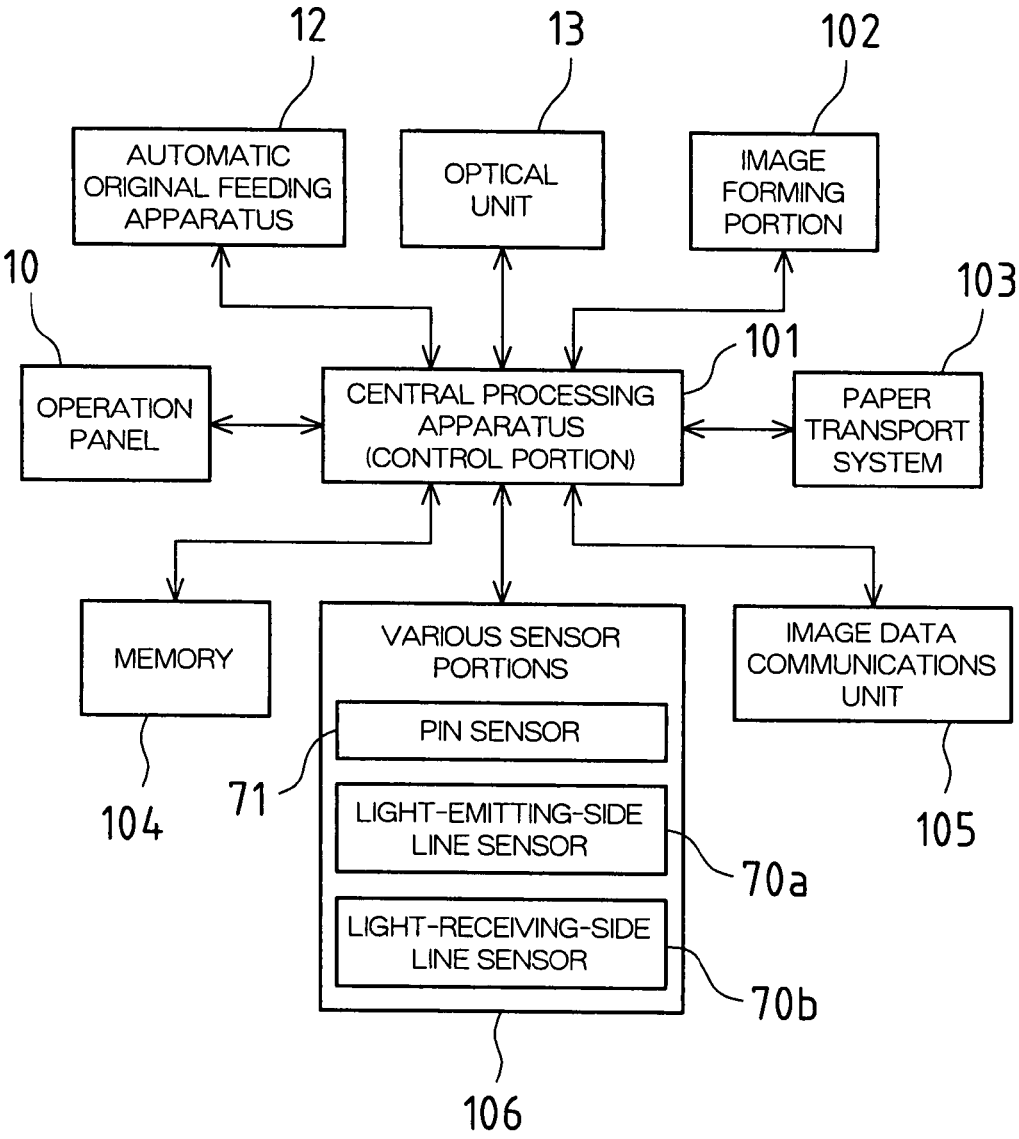
FIG. 3 is a block diagram that shows the configuration of a control system of the image forming apparatus of the present embodiment.

Following is a description of the configuration of a control system in the image forming apparatus 1 with the above configuration, with reference to a block diagram shown in FIG. 3.

A central processing apparatus (control portion) 101 performs sequence control to manage each of drive mechanism portions that are used to configure the image forming apparatus 1, such as the automatic original feeding apparatus 12, the optical unit 13, an image forming portion 102, and a paper transport system 103. Furthermore, the control portion 101 outputs control signals to each portion based on detection values of various sensor portions 106, including the above paper transport position detection portion 70 and the paper detection portion 71 (a pin sensor). The paper transport position detection portion 70 may employ a CIS sensor configured from the light emitting portion 70*a* and the light receiving portion 70*b* of a line sensor that employs a method of coupling using an array of equal magnification lenses that are lined up in a single line and correspond to pixels, a CCD sensor, or the like. In the present embodiment a CIS sensor is used in the paper transport position detection portion 70.

The operation panel 10 is connected to the control portion 101 in a state such that they can communicate with each other, and the image forming apparatus 1 is operated according to print processing conditions input and set by a user by operating the operation panel 10.

Also, a memory 104 and an image data communications unit 105 are connected to the control portion 101. Various control information necessary in order to control each of the drive mechanism portions that are used to configure the image forming apparatus 1 is stored in the memory 104. Also, detection values of paper and the transport position of that paper that have been detected by the paper detection portion 71 and the paper transport position detection portion 70 are stored in order as history in the memory 104. The image data communications unit 105 is provided in order to allow information communications with other digital image devices, such as communication of image information, image control signals, or the like.

The control portion 101 performs print processing control according to the print processing conditions that have been input and set by a user by operating the operation panel 10. Specifically, when performing consecutive print processing to a plurality of sheets of paper, by controlling the paper transport system 103 (the registration rollers R51 and R52 and the pre-registration rollers R41 and R42, and the like) that transports the paper based on the detection values of the paper transport position detection portion 70, a correction amount of the position of image writing to the photosensitive drum 14 is determined based on the paper transport position in the paper transport path detected by the paper transport position detection portion 70 for a sheet of paper that has been set in advance among the plurality of sheets of paper, and the image writing position is corrected based on the correction amount. Processing for image forming on paper is performed at the image forming position (see the nip portion N1) based on the image writing position after correction, and after the sheet of paper that was set in advance, image forming on other paper is performed directly or indirectly at the image forming position based on the image writing position after correction is performed with respect to that other paper. The correction amount of the image writing position referred to here is determined based on the displacement amount of the paper transport position detected by the paper transport position detection portion 70 in the paper transport path relative to the paper transport position of the sheet of paper that has been set in advance. Also note that the correction amount of the image writing position in the present embodiment refers to a displacement amount such that the displacement of images formed on the front and back faces of paper is not more than 0.5 mm when the same image has been formed at the same position on the front and back faces of the paper.

Also, with the control portion 101, correction of the image writing position is performed independently for each of the plurality of paper feed portions, such as the automatic duplex paper feed apparatus 23, the paper feed cassettes 26, and the LCC 60. That is, correction of the image writing position is performed by each paper feed portion such as the automatic duplex paper feed apparatus 23, the four paper feed cassettes 26, and the LCC 60, and these paper feed portions are not affected by correction of the image writing position that has been performed for each of the other paper feed portions.

With the image forming apparatus 1 according to the present embodiment described above, the registration rollers R51 and R52 are provided upstream in the paper transport path from the image forming position, and the paper transport position detection portion 70 is provided upstream in the paper transport path from the registration rollers R51 and R52. When performing consecutive print processing to a plurality of sheets of paper, the paper transport position in the paper transport path is detected by the paper transport position detection portion 70 for a sheet of paper that has been set in advance among the plurality of sheets of paper, a correction amount of the position of image writing to the photosensitive drum 14 is determined based on the detected paper transport position, correction of the image writing position is performed based on the correction amount, image forming on paper is performed directly or indirectly at the image forming position based on the image writing position after correction, and image forming on other paper is performed directly or indirectly at the image forming position based on the image writing position after correction is performed with respect to that other paper. Thus, the desired image forming position on the paper and the position of image writing to the photosensitive drum 14 can be matched together with good precision even in a high speed device. Also, with respect to the image forming position of other sheets of paper, detection of the paper transport position by the paper transport position detection portion 70 for a sheet of paper that has been set in advance is utilized, so even in a high speed device, image forming can be performed while correcting the image forming position of a plurality of sheets of paper. Also, even when detection of the paper transport position of other sheets of paper is performed by the paper transport position detection portion 70 after image writing has started, correction of the image writing position for those other sheets of paper can be appropriately performed.

Following is a description of correction of the image writing position for image forming on paper, with reference to specific examples (Examples 1 to 9).

EXAMPLE 1

Figure 4:
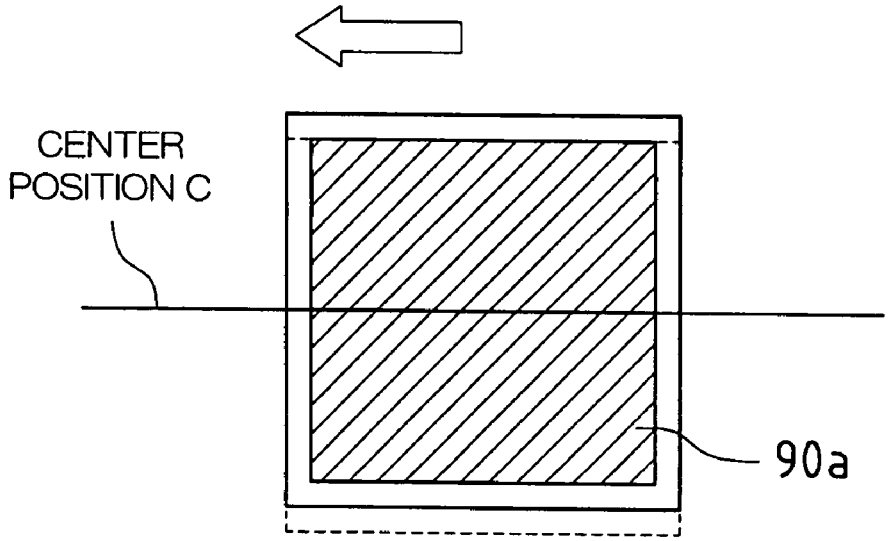
FIG. 4 is a schematic view that shows the relationship between paper and a center position of a paper transport position in a transport path when adjusting an off-center amount of a paper transport position of the paper, according to Example 1.
Figure 5:
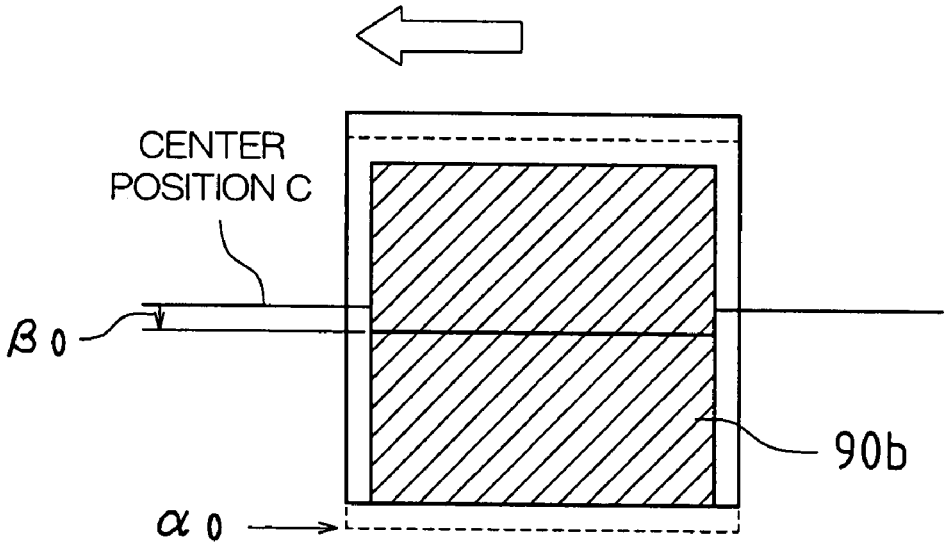
FIG. 5 is a schematic view that shows the relationship between paper and a center position of a paper transport position in a transport path when an off-center amount of a paper transport position of the paper has been adjusted, according to Example 1.

The displacement amount of the paper transport position of paper in Example 1 is the off-center amount of the paper transport position of the paper in a direction perpendicular to the transport direction of the paper transport path. Below, processing to correct the image writing position according to Example 1 is described with reference to FIGS. 4 to 10. When manufacturing the image forming apparatus 1, initial setting of the image forming apparatus is performed in the following manner. First, with the image writing position set as an initial reference position (the position in an unadjusted state immediately after manufacture), image forming of image information 90*a* of a test pattern is performed (a test print is performed) at the initial reference position. The image information 90*a* of the initial reference position is shown in FIG. 4. As shown in FIG. 4, a center position C of the paper is displaced downward relative to the paper transport direction (the direction of the arrow), and paper is transported in a state displaced downward (dotted line) relative to a paper transport position set for the paper in advance (solid line), that paper transport position $\alpha 0$ is measured by the paper transport position detection portion 70 and stored in the memory 104. The person making the setting views the test print, as shown in FIG. 5, determines a reference adjustment amount (the reference adjustment amount is the displacement amount from the initial reference position) $\beta 0$ of the position of image writing to the photosensitive drum 14 such that the image writing position of the image information 90*a* matches the paper transport position of the first sheet of paper stopped by the registration rollers R51 and R52 (matching at the dotted lines), adjusts the image writing position, and ends initial setting of the image forming position. The position of the image information after adjustment is shown is denoted as 90*b* in FIG. 5.

It is necessary to perform the initial setting of the image forming position described above individually for each of the plurality of paper feed portions. As stated above, the plurality of paper feed portions includes each of the plurality of paper feed cassettes 26, the LCC 60, and the automatic duplex paper feed apparatus 23 provided with the re-transport roller 36. The above paper transport position $\alpha 0$ and the reference adjustment amount $\beta 0$ according to the initial setting are set individually for each of the plurality of paper feed portions. The processing to correct the image writing position during ordinary use described below is executed using the paper transport position $\alpha 0$ and the reference adjustment amount $\beta 0$ that have been set corresponding to the paper feed portion that feeds paper during print processing. Also, when re-printing in the duplex printing mode (printing to the back face), the correction processing is executed using the paper transport position $\alpha 0$ and the reference adjustment amount $\beta 0$ that have been set for the automatic duplex paper feed apparatus 23.

Figure 6:
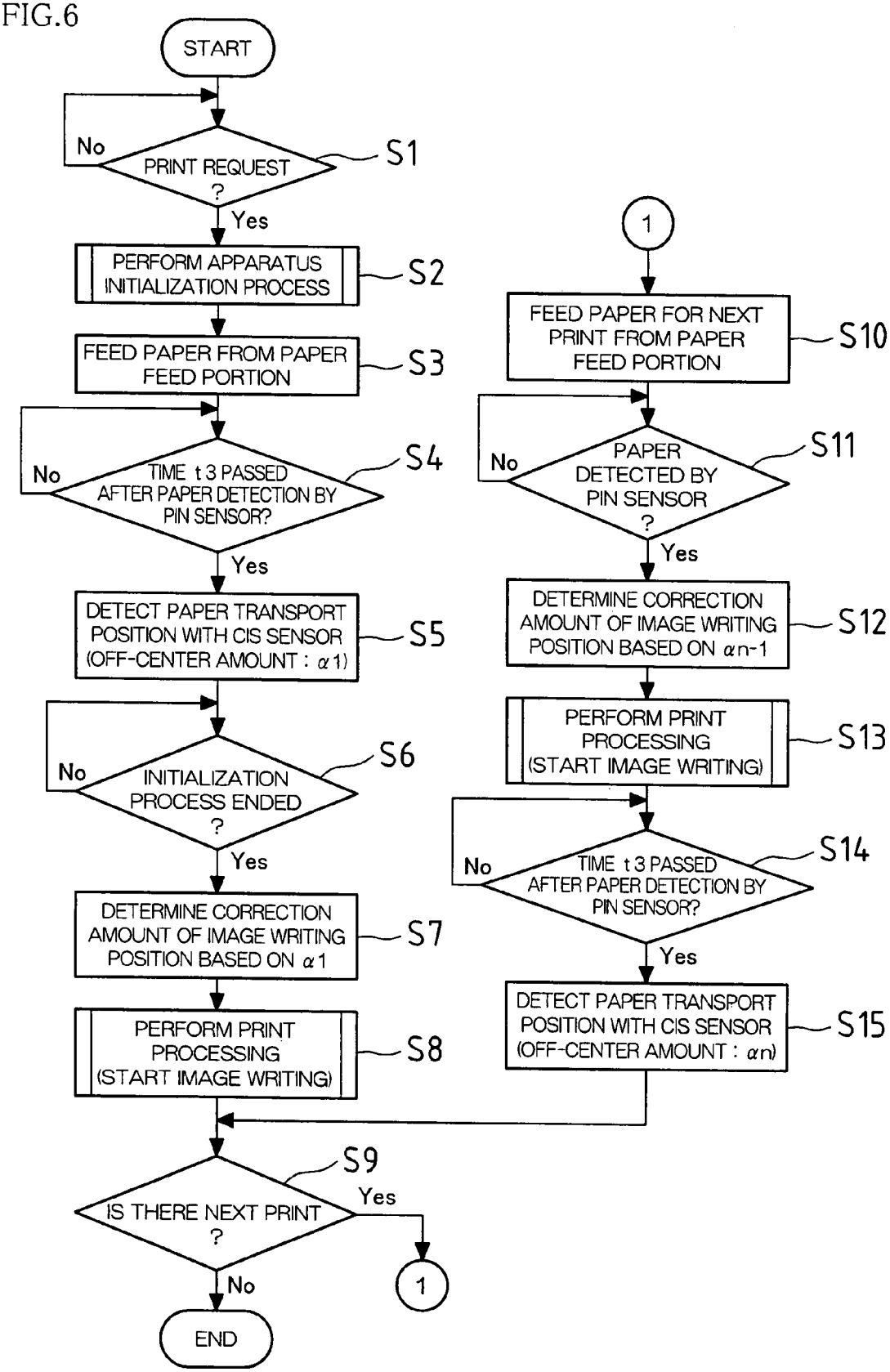
FIG. 6 is a flowchart that illustrates processing to correct an image writing position according to Example 1.

Next is a description of processing to correct the image writing position during ordinary use (automatic correction), with reference to FIG. 6. When the image forming apparatus 1 is started up, and due to operation of the operation panel 10 a print request is received for consecutive print processing to a plurality of sheets of paper (Yes in Step S1), the control portion 101 starts a device initialization process (related to image forming processing)(Step S2). For example, at the photosensitive drum 14, an initialization process of, namely, adjusting of the charging potential provided by the charging unit 15, or removing toner stains on the surface of the photosensitive drum 14 by the cleaner 18, is started.

Figure 7:
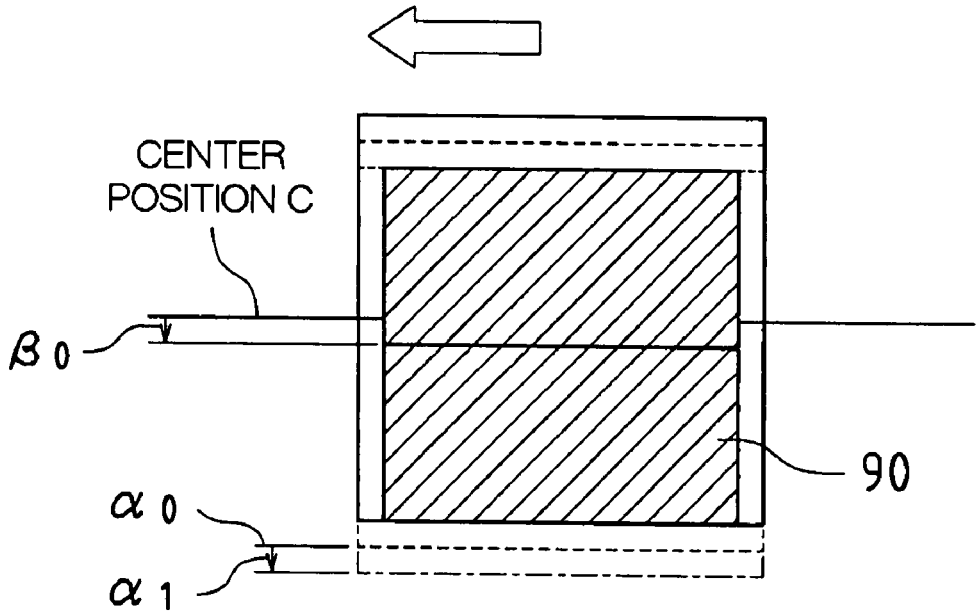
FIG. 7 is a schematic view that shows the relationship between paper and a center position of a paper transport position in a transport path when adjusting an off-center amount of a paper transport position of the paper, according to Example 1.

At this time, the control portion 101 feeds one sheet of paper from one of the paper feed cassettes 26 (Step S3), and transports that sheet of paper in the direction of the photosensitive drum 14 with the transport rollers R31 and R32 via the shared transport path 28, and that paper is stopped with the trailing edge of the paper held sandwiched by the pre-registration rollers R41 and R42, and the leading edge of the paper making contact with the registration rollers R51 and R52. After the paper transported in the direction of the photosensitive drum 14 at this time is detected by the paper detection portion 71 (PIN sensor), the leading edge of the paper arrives at the registration rollers R51 and R52. At this time, when a time t3 passes after paper detection by the paper detection portion 71 (PIN sensor)(when judged Yes in Step S4), an off-center amount $\alpha 1$ is measured by detecting the paper transport position in the paper transport path for the first sheet of paper with the paper transport position detection portion 70 (CIS sensor configured from the light emitting portion 70*a* and the light receiving portion 70*b* of a line sensor)(Step S5), and the off-center amount $\alpha 1$ is stored in the memory 104. As shown in FIG. 7, the off-center amount $\alpha 1$ indicates the distance between the paper transport position $\alpha 0$ at the time of the initial setting and the presently measured paper transport position. In this state, the initialization process of the apparatus ends (Yes in Step S6).

When the initialization process of the apparatus ends, the control portion 101 determines the correction amount of the position of image writing to the photosensitive drum 14 for the first sheet of paper such that the image writing position of the image information that has been made visible on the photosensitive drum 14 matches the paper transport position of the first sheet of paper stopped by the registration rollers R51 and R52, based on the image writing position after correction (based on the off-center amount $\alpha 1$)(Step S7).

Figure 8:
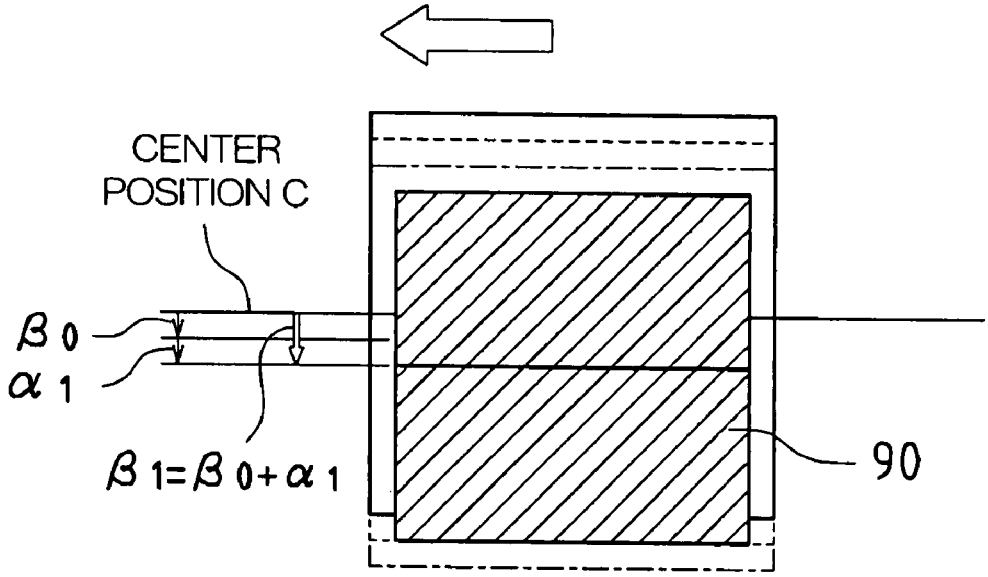
FIG. 8 is a schematic view that shows the relationship between paper and a center position of a paper transport position in a transport path when an off-center amount of a paper transport position of the paper has been adjusted, according to Example 1.

Steps S5 to S7 above are described with reference to FIGS. 7 and 8. For example, as shown in FIG. 7, when the center position C of the paper is displaced downward relative to the paper transport direction (the direction of the arrow), and paper is transported in a state displaced downward (dotted line) relative to the paper transport position set for the paper in advance (solid line), that displacement amount is stored in the memory 104 as the off-center amount $\alpha 1$. As shown in FIG. 8, the image writing position is corrected with the correction amount of the position of image writing to the photosensitive drum 14 determined such that the image writing position of image information 90 that has been made visible on the photosensitive drum 14 matches the paper transport position of the first sheet of paper stopped by the registration rollers R51 and R52 (matched to the single-dotted chained line). The correction amount of the image writing position $\beta 1$ is specifically determined from $\beta 1=\beta 0+\alpha 1$.

After Step S7, the control portion 101 starts print processing (Step S8). More specifically, the control portion 101 performs correction of the image writing position based on the correction amount determined above (see FIG. 8), and resumes driving of the registration rollers R51 and R52 and the pre-registration rollers R41 and R42 based on the image writing position after correction to start transport of the first sheet of paper in order to perform image forming (print processing) on the first sheet of paper at the image forming position (see nip portion N1).

At the same time, the control portion 101 checks whether or not there is subsequent printing (Step S9), and when there is subsequent printing, the control portion feeds the next sheet of paper (in this case, the second sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor) (Yes in Step S11), after paper detection by the PIN sensor, the control portion 101 determines the correction amount of the position of image writing to the photosensitive drum 14 for the second sheet of paper such that the image writing position of the image information that has been made visible on the photosensitive drum 14 matches the paper transport position of the second sheet of paper, based on the image writing position after correction (based on the off-center amount $\alpha n-1$ of the prior sheet of paper)(Step S12). Then, the control portion 101 performs correction of the image writing position based on the correction amount determined in Step S12 (specifically, correction amount $\beta n=\beta 0+\alpha n-1$). The control portion 101 starts print processing for the second sheet of paper based on the image writing position after correction (Step S13).

After print processing is started for the second sheet of paper, that paper is temporarily stopped with the trailing edge of the paper held sandwiched by the pre-registration rollers R41 and R42, and the leading edge of the paper making contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the second sheet of paper with the paper transport position detection portion 70 (CIS sensor configured from the light emitting portion 70*a* and the light receiving portion 70*b* of a line sensor)(Step S15), and this off-center amount $\alpha n(n=2)$ is stored in the memory 104.

After the off-center amount $\alpha n(n=2)$ is stored in the memory 104, the control portion 101 checks whether or not there is subsequent printing (Step S9), and when there is subsequent printing, the control portion 101 feeds the next sheet of paper (in this case, the third sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor) (Yes in Step S11), after paper detection by the PIN sensor, the control portion 101 determines the correction amount of the position of image writing to the photosensitive drum 14 for the third sheet of paper such that the image writing position of the image information that has been made visible on the photosensitive drum 14 matches the paper transport position of the third sheet of paper, based on the image writing position after correction (based on the off-center amount $\alpha n-1$ of the prior sheet of paper)(Step S12). Then, the control portion 101 performs correction of the image writing position based on the correction amount determined in Step S12 (specifically, correction amount $\beta n=\beta 0+\alpha n-1$). The control portion 101 starts print processing for the second sheet of paper based on the image writing position after correction (Step S13).

After print processing is started for the third sheet of paper, that paper is temporarily stopped with the trailing edge of the paper held sandwiched by the pre-registration rollers R41 and R42, and the leading edge of the paper making contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the third sheet of paper with the paper transport position detection portion 70 (CIS sensor configured from the light emitting portion 70*a* and the light receiving portion 70*b* of a line sensor)(Step S15), and this off-center amount $\alpha n(n=3)$ is stored in the memory 104.

In the manner described above, the control portion 101 repeats the processing of above Steps S9 to S15 to further execute print processing for the fourth and subsequent sheets of paper.

Figure 9:
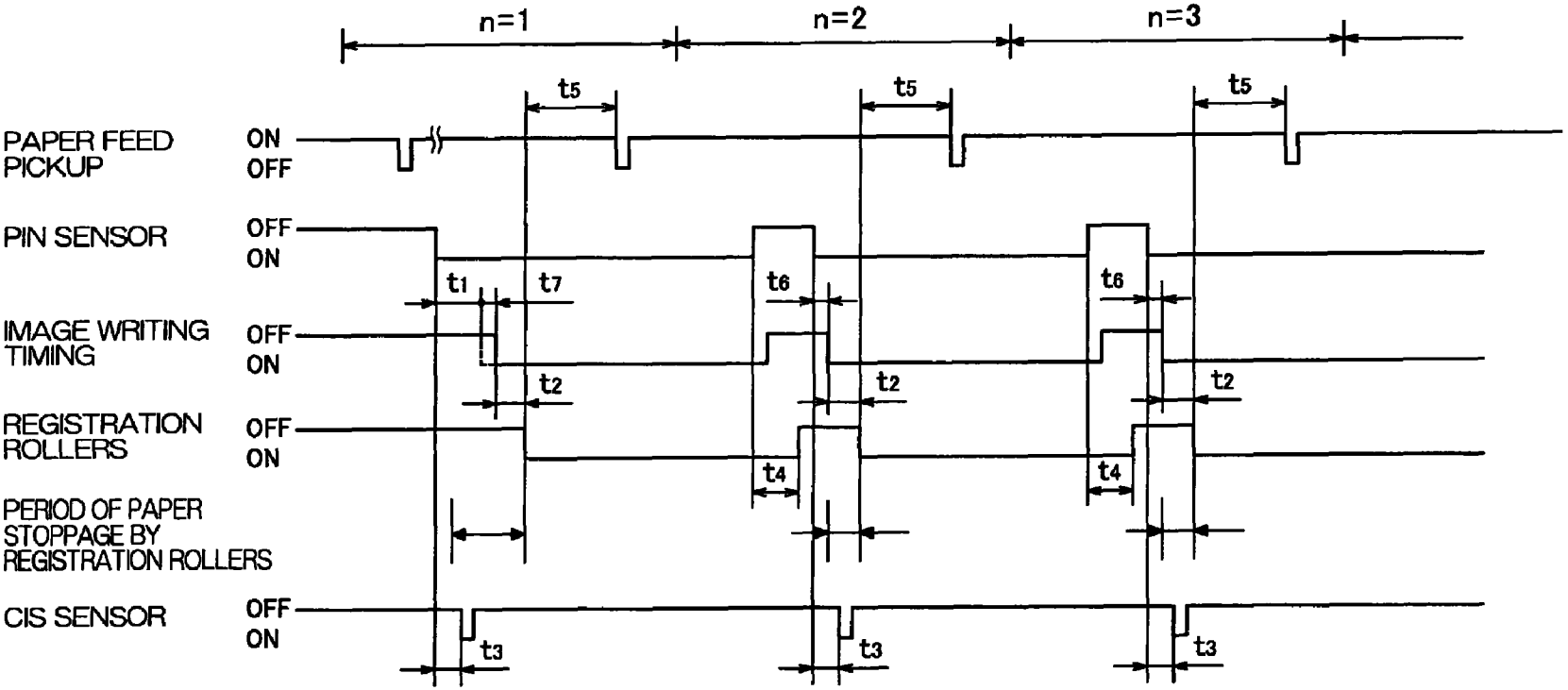
FIG. 9 is a timing chart that shows, with respect to Example 1, the relationship between an ON/OFF state for a paper feed pickup detection, an ON/OFF state for paper detection by a PIN sensor, an ON/OFF state of write timing of image information, an ON/OFF state for transport driving of registration rollers R51 and R52, and an ON/OFF state for paper transport position detection of a CIS sensor.

The timing chart shown in FIG. 9 shows, with respect to Example 1, the relationship between an ON/OFF state for a paper feed pickup detection, an ON/OFF state for paper detection by a PIN sensor (the paper detection portion 71), an ON/OFF state of write timing of image information by a laser to the photosensitive drum 14, an ON/OFF state for transport driving of the registration rollers R51 and R52, and an ON/OFF state for paper transport position detection of a CIS sensor (the paper transport position detection portion 70). The times shown in FIG. 9 are as follows. A time t1 indicates the time from paper detection by the PIN sensor until image writing is performed. A time t2 indicates the time from image writing until transport of paper by the registration rollers R51 and R52. The time t3 indicates the time from paper detection by the PIN sensor until paper transport position detection by the CIS sensor. A time t4 indicates the time from paper trailing edge detection by the PIN sensor until paper transport stoppage by the registration rollers R51 and R52 for the second and subsequent sheets of paper. A time t5 indicates the time from paper transport by the registration rollers R51 and R52 until start of paper pickup by the paper feed roller 27. A time t6 indicates the time from paper detection by the PIN sensor until image writing for the second and subsequent sheets of paper. A time t7 indicates a delay time relative to the time t1 due to initialization of the apparatus.

As shown in FIG. 9, according to Example 1, the detection values of the first sheet of paper are used, so unlike the conventional technology shown in FIG. 10 described below, paper transport position detection by the CIS sensor is performed at an earlier timing than the writing of image information by the laser to the photosensitive drum 14. Thus, with respect to the stoppage period of the registration rollers R51 and R52 from paper transport position detection by the CIS sensor until transport driving by the registration rollers R51 and R52, it is possible to set the stoppage period for the first sheet of paper longer than the stoppage period for the second and subsequent sheets of paper. Also, the stoppage period for the first sheet of paper can be allowed to overlap with the initialization process (startup time) or the like of the apparatus itself, so the stoppage period for the first sheet of paper can be effectively used. Also, the detection values of the first sheet of paper are used for the second and subsequent sheets of paper, so it is not necessary to adopt a long stoppage period, and thus this configuration is suitable for a high speed device. Also note that in Example 1, as shown in FIG. 9, paper transport position detection is performed by the CIS sensor for all sheets of paper, but this is not a limitation; paper transport position detection may be performed by the CIS sensor for a desired sheet of paper as necessary.

Figure 10:
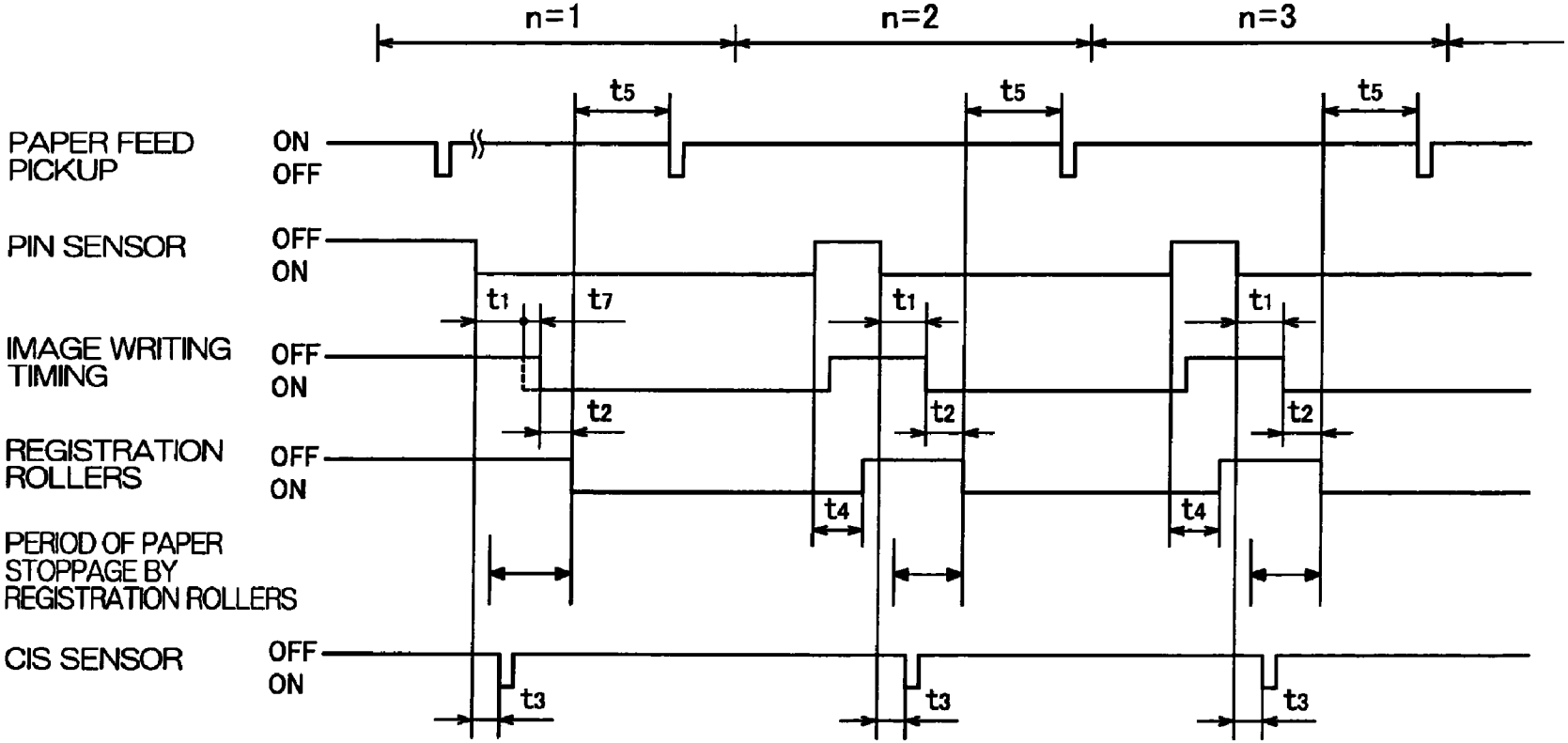
FIG.10 Prior Art
FIG. 10 is a timing chart that shows, with respect to conventional technology, the relationship between an ON/OFF state for a paper feed pickup detection, an ON/OFF state for paper detection by a PIN sensor, an ON/OFF state of write timing of image information, an ON/OFF state for transport driving of registration rollers, and an ON/OFF state for paper transport position detection of a CIS sensor.

On the other hand, with the conventional technology shown in FIG. 10, with respect to the stoppage period of the registration rollers R51 and R52, the stoppage period is set to the same short period for all paper. Thus, like Example 1, this configuration is suitable to a high speed device, but with this conventional technology, as shown in FIG. 10, paper transport position detection is performed by the CIS sensor from the first sheet of paper, after writing of image information by the laser to the photosensitive drum 14. Thus, unlike in Example 1, it is not possible to perform correction of the position of image forming on the paper, so displacement of the image position on the paper occurs. Also note that for the conventional technology shown in FIG. 10, in order to make a comparison with FIG. 9, a timing chart is used in which for the sake of convenience, the stoppage period matches the stoppage period in FIG. 9. Thus, the times t1 to t5 and t7 shown in FIG. 10 have the same content as the times t1 to t5 and t7 shown in FIG. 9, so a description thereof is omitted here.

As described above, in Example 1, the correction amount of the image writing position is determined for the second and subsequent sheets of paper using the detection values of the first sheet of paper. More specifically, the detection values for the second and subsequent sheets of paper are not actually used; the detection values for the first sheet of paper are used, so as shown in FIG. 9, even when detection of the paper transport position by the paper transport position detection portion 70 is performed after starting image writing for the second or subsequent sheet of paper, correction of the image writing position can be appropriately performed for that sheet of paper. Thus, for example, even in high speed transfer in which about two sheets of A4 landscape paper are transported in one second, it is possible to easily and reliably determine, with time to spare, the correction amount of the image writing position for paper that is temporarily stopped by the registration rollers R51 and R52.

Specifically, with the image forming apparatus 1 according to the present embodiment described above, when performing consecutive print processing to a plurality of sheets of paper, the paper transport position in the paper transport path is detected by the paper transport position detection portion 70 for the first sheet of paper among the plurality of sheets of paper, a correction amount of the position of image writing to the photosensitive drum 14 is determined based on the detected paper transport position, correction of the image writing position is performed based on the correction amount, image forming on paper is performed directly at the image forming position based on the image writing position after correction, and image forming on the second and subsequent sheets of paper is performed directly at the image forming position based on the image writing position after correction is performed with respect to that other paper. Thus, the desired image forming position on the paper and the position of image writing to the photosensitive drum 14 can be matched together with good precision even in a high speed device. Also, with respect to the image forming position of the second and subsequent sheets of paper, detection by the paper transport position detection portion 70 with respect to the first sheet of paper is utilized, so image forming can be performed while correcting the image forming position of a plurality of sheets of paper even in a high speed device. Also, even when detection of the paper transport position of the second and subsequent sheets of paper is performed by the paper transport position detection portion 70 after image writing has started, correction of the image writing position for those other sheets of paper can be appropriately performed.

Also, the correction amount of the image writing position is determined based on the displacement amount of the paper transport position of the paper detected by the paper transport position detection portion 70 relative to the paper transport position of a sheet of paper that has been set in advance in the paper transport path, so correction of the image writing position in a desired direction is possible, and as a result, this configuration is compatible with displacement of the paper transport position in the paper transport path in a desired direction.

Also, the displacement amount of the paper transport position is the off-center amount of the paper transport position of the paper in the direction perpendicular to the transport direction of the paper transport path, and during consecutive print processing to a plurality of sheets of paper, the off-center amount of the first sheet of paper in the paper transport path is measured by the paper transport position detection portion 70, the correction amount of the position for image writing to the photosensitive drum 14 is determined based on the off-center amount, correction of the image writing position is performed based on the correction amount, image forming on paper is performed directly at the image forming position based on the image writing position after correction, and image forming on the second and subsequent sheets of paper is performed directly at the image forming position based on the image writing position after correction is performed with respect to that other paper. Thus, this configuration is compatible with displacement of the paper transport position in the direction perpendicular to the transport direction of the paper transport path.

Also, a plurality of paper feed portions that transport paper to the image forming position are provided upstream from the registration rollers R51 and R52 in the paper transport path, and correction of the image writing position is performed independently for each of the plurality of paper feed portions, so regardless of the function of the plurality of paper feed functions, it is possible to perform correction of the image writing position while distinguishing between each of the plurality of paper feed portions. As a result, image forming to paper stored in the respective paper feed portions can be appropriately performed regardless of which paper feed portion is the source of the paper.

Also, the paper transport position detection portion 70 detects the paper transport position in a state in which the paper has been stopped by the registration rollers R51 and R52, so it is possible to detect the paper transport position in a state in which displacement of the paper transport in the paper transport path has been eliminated, and so it is possible to suppress displacement of the paper transport position due to displacement of the paper transport.

EXAMPLE 2

The displacement amount of the paper transport position of paper in Example 2 is, same as in Example 1, the off-center amount of the paper transport position of the paper in the direction perpendicular to the transport direction in the paper transport path. Following is a description of processing to correct the image writing position according to Example 2, with reference to FIG. 11. In Example 2, same as in Example 1, the processing to correct the image writing position is performed after adjusting the image writing position. Also, in FIG. 11, the same processing as in the flowchart shown in FIG. 6 is denoted by the same step numbers. Also, because Example 2 has the same flowchart as Example 1, Example 2 also has the characteristic working effects related to this flowchart as Example 1.

The paper transport position of paper that has been temporarily stopped by the registration rollers R51 and R52 is not limited to being necessarily the same for consecutive sheets of paper; it is possible that some amount of displacement will occur. In consideration of this point, in Example 2, by obtaining an average value of detection values for the transport position of consecutively transported sheets of paper, this sort of slight displacement for each sheet of paper is absorbed, and so the correction amount of the image writing position is determined with higher accuracy. Specifically, in Example 2, the correction amount of the image writing position is measured for a plurality of sheets of paper that have been set in advance, transported from the same paper feed portion (such as one of the paper feed cassettes 26), and the average value of the plurality of measured correction values is set as the correction value of the image writing apparatus.

Figure 11:
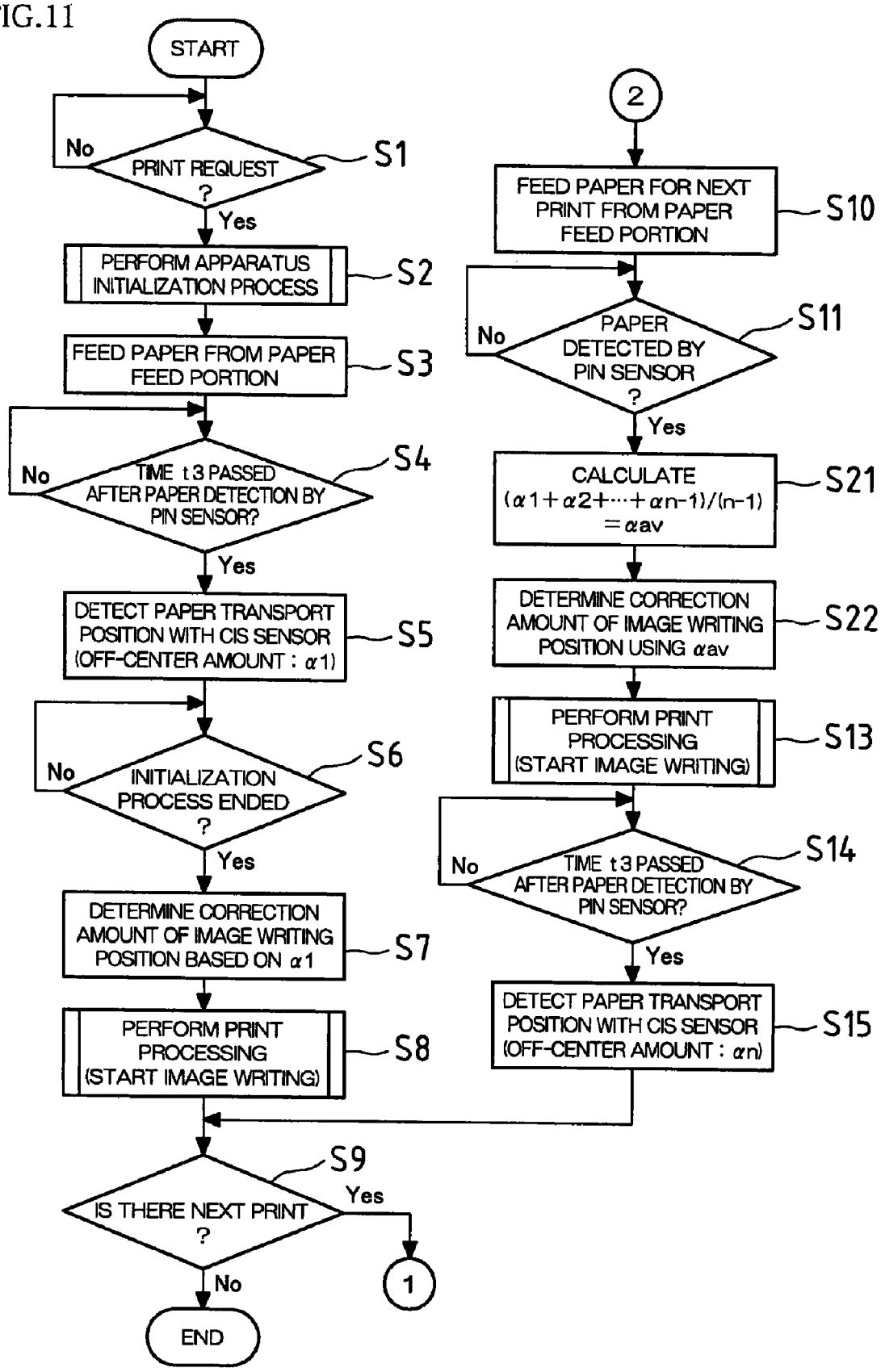
FIG. 11 is a flowchart that illustrates processing to correct an image writing position according to Example 2.

As shown in FIG. 11, when the image forming apparatus 1 is started up, and due to operation of the operation panel 10 a print request is received for consecutive print processing to a plurality of sheets of paper (Yes in Step S1), the control portion 101 starts a device initialization process (related to image forming processing)(Step S2).

At this time, the control portion 101 feeds one sheet of paper from one of the paper feed cassettes 26 (Step S3), and transports that sheet of paper in the direction of the photosensitive drum 14 with the transport rollers R31 and R32 via the shared transport path 28, and the paper is stopped with the trailing edge of the paper held sandwiched by the pre-registration rollers R41 and R42, and the leading edge of the paper making contact with the registration rollers R51 and R52. After the paper transported in the direction of the photosensitive drum 14 at this time is detected by the paper detection portion 71 (PIN sensor), the leading edge of the paper arrives at the registration rollers R51 and R52. At this time, when the time t3 passes after paper detection by the paper detection portion 71 (PIN sensor)(when judged Yes in Step S4), an off-center amount $\alpha 1$ is measured by detecting the paper transport position in the paper transport path for the first sheet of paper with the paper transport position detection portion 70 (CIS sensor configured from the light emitting portion 70*a* and the light receiving portion 70*b* of a line sensor)(Step S5), and the off-center amount $\alpha 1$ is stored in the memory 104. In this state, the initialization process of the apparatus ends (Yes in Step S6).

When the initialization process of the apparatus ends, the control portion 101 determines the correction amount of the position of image writing to the photosensitive drum 14 for the first sheet of paper such that the image writing position of the image information that has been made visible on the photosensitive drum 14 matches the paper transport position of the first sheet of paper stopped by the registration rollers R51 and R52, based on the off-center amount $\alpha 1$(Step S7). Specifically, the correction amount is obtained from $\beta 1=\beta 0+\alpha 1$.

After above Step S7, the control portion 101 starts print processing (Step S8). More specifically, the control portion 101 performs correction of the image writing position based on the correction amount determined above, and resumes driving of the registration rollers R51 and R52 and the pre-registration rollers R41 and R42 based on the image writing position after correction to start transport of the first sheet of paper in order to perform image forming (print processing) on the first sheet of paper at the image forming position (see nip portion N1).

At the same time, the control portion 101 checks whether or not there is subsequent printing (Step S9), and when there is subsequent printing, the control portion feeds the next sheet-of paper (in this case, the second sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor) (Yes in Step S11), after paper detection by the PIN sensor, the control portion 101, using the off-center amount $\alpha 1$ of the prior sheet of paper, calculates $\alpha av=\alpha 1/1$ (Step S21), and based on the result of that calculation $\alpha av$ (in this case, $\alpha 1$), determines the correction amount of the position of image writing to the photosensitive drum 14 for the second sheet of paper such that the image writing position of the image information that has been made visible on the photosensitive drum 14 matches the paper transport position of the second sheet of paper (Step S22). Specifically, the correction amount is obtained from $\beta n=\beta 0+\alpha av$. Then, the control portion 101 performs correction of the image writing position based on the correction amount determined in Step S22, and transports the second sheet of paper based on the image writing position after correction in order to perform image forming (print processing) on the second sheet of paper at the image forming position (see nip portion N1), and performs correction of the image writing position based on the correction amount (specifically, correction amount $\beta n=\beta 0+\alpha n-1$) determined in Step S22. The control portion 101 starts print processing for the second sheet of paper based on the image writing position after correction (Step S13).

After print processing is started for the second sheet of paper, that paper is temporarily stopped with the trailing edge of the paper held sandwiched by the pre-registration rollers R41 and R42, and the leading edge of the paper making contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the second sheet of paper with the paper transport position detection portion 70 (CIS sensor configured from the light emitting portion 70*a* and the light receiving portion 70*b* of a line sensor)(Step S15), and this off-center amount $\alpha n(n=2)$ is stored in the memory 104.

After the off-center amount $\alpha n(n=2)$ is stored in the memory 104, the control portion 101 checks whether or not there is subsequent printing (Step S9), and when there is subsequent printing, the control portion 101 feeds the next sheet of paper (in this case, the third sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor) (Yes in Step S11), after paper detection by the PIN sensor, the control portion 101, using all of the offset amounts $\alpha 1$ and $\alpha 2$ up to the previous sheet of paper, calculates $\alpha av=(\alpha 1+\alpha 2)/2$ (Step S21), and based on this average value $\alpha av$, determines the correction amount of the position of image writing to the photosensitive drum 14 for the third sheet of paper such that the image writing position of the image information that has been made visible on the photosensitive drum 14 matches the paper transport position of the third sheet of paper (Step S22). Specifically, the correction amount is obtained from $\beta n=\beta 0+\alpha av$. Then, the control portion 101 performs correction of the image writing position based on the correction amount determined in Step S22, and transports the third sheet of paper based on the image writing position after correction in order to perform image forming (print processing) on the third sheet of paper at the image forming position (see nip portion N1), and performs correction of the image writing position based on the correction amount (specifically, correction amount $\beta n=\beta 0+\alpha n-1$) determined in Step S22. The control portion 101 starts print processing for the third sheet of paper based on the image writing position after correction (Step S13).

After print processing is started for the third sheet of paper, the trailing edge of the paper is held sandwiched by the pre-registration rollers R41 and R42, and the paper is stopped by causing the leading edge of the paper to make contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the third sheet of paper with the paper transport position detection portion 70 (CIS sensor configured from the light emitting portion 70*a* and the light receiving portion 70*b* of a line sensor)(Step S15), and this off-center amount $\alpha n(n=3)$ is stored in the memory 104.

In the manner described above, the control portion 101 repeats the processing of above Steps S9 to S22 to further execute print processing for the fourth and subsequent sheets of paper. Specifically, the control portion 101 executes print processing for the second and subsequent sheets of paper by repeating the processing of above Steps S9 to S22, and in Step S21, by calculating $\alpha av=(\alpha 1+\alpha 2+\ldots+\alpha n-1)/(n-1)$ for each successive sheet of paper using all of the offset amounts $\alpha 1$, $\alpha 2$, . . . , $\alpha n-1$ up to the previous sheet of paper, print processing is executed for the second and subsequent sheets of paper.

As described above, in Example 2, the correction amount of the image writing position is determined for the second and subsequent sheets of paper using all of the detection values for all sheets of paper up to the sheet immediately previous to the sheet currently being transported by the registration rollers R51 and R52. More specifically, the detection values for the second and subsequent sheets of paper are not actually used for that sheet of paper; all detection values of all sheets of paper up to the previous sheet of paper are used, so even before that sheet of paper is transported to the registration rollers R51 and R52, it is possible to determine the transport restart timing for that sheet of paper. Thus, for example, even in high speed transfer in which about two sheets of A4 landscape paper are transported in one second, it is possible to easily and reliably determine, with time to spare, the correction amount of the image writing position for paper that is temporarily stopped by the registration rollers R51 and R52.

Also, according to Example 2, the correction amount of the image writing position is measured for a plurality of sheets of paper that have been set in advance, transported from the same paper feed portion (one of the paper feed cassettes 26), and the average value of the plurality of measured correction values is set as the correction value of the image writing apparatus. Thus, the correction value of the image writing position corresponds to a plurality of sheets of paper, and so it is possible to increase the precision of matching the desired image forming position on the paper with the position for image writing on the photosensitive drum 14. Also, the plurality of sheets of paper with which the correction value corresponds are not limited to paper transported consecutively as in Example 2; this paper may be set as desired. For example, the paper with which the correction value corresponds may be set as desired to an odd or an even number of sheets of paper that skips one sheet, or from one to 10-30 sheets of paper (see Example 3 below), or two to eight sheets of paper, or the like.

EXAMPLE 3

The displacement amount of the paper transport position of paper in Example 3 is, same as in Example 2, the off-center amount of the paper transport position of the paper in the direction perpendicular to the transport direction in the paper transport path. Following is a description of processing to correct the image writing position according to Example 3, with reference to FIG. 12. In Example 3, same as in Example 2, the processing to correct the image writing position is performed after adjusting the image writing position. Also, in FIG. 12, the same processing as in the flowchart shown in FIG. 11 is denoted by the same step numbers. Also, because Example 3 has the same flowchart as Example 2 (and also Example 1), Example 3 also has the characteristic working effects related to this flowchart as Example 2.

In Example 3, the paper transport position of paper when temporarily stopped by the registration rollers R51 and R52 is likely to be gradually displaced over time. However, while that displacement does not differ greatly from a previously transported sheet of paper to a sheet of paper transported next, it is possible that there will be much displacement between, for example, the first sheet of paper and the 31st sheet of paper. For example, when consecutively printing a plurality of sheets (e.g, high volume printing of 500 sheets or the like), it is conceivable that thermal expansion of the registration rollers R51 and R52 occurs due to heat generated by friction with the paper, and because the paper transport position may gradually change due to this thermal expansion or the like, it is possible that precision will worsen when initial values are permanently used for the average value calculation. In Example 3, in consideration of this point, the processing to calculate the average value is initialized.

In Example 3, a fixed number of sheets is set to 30 sheets. That is, the number of sheets for which there was a print request is divided into groups of 30 sheets, the processing to calculate the average value $\alpha av$ is initialized for each of these divisions, i.e. for each 30 sheets. The fixed number of sheets is not limited to 30 sheets; the number of sheets can be set as desired.

Figure 12:
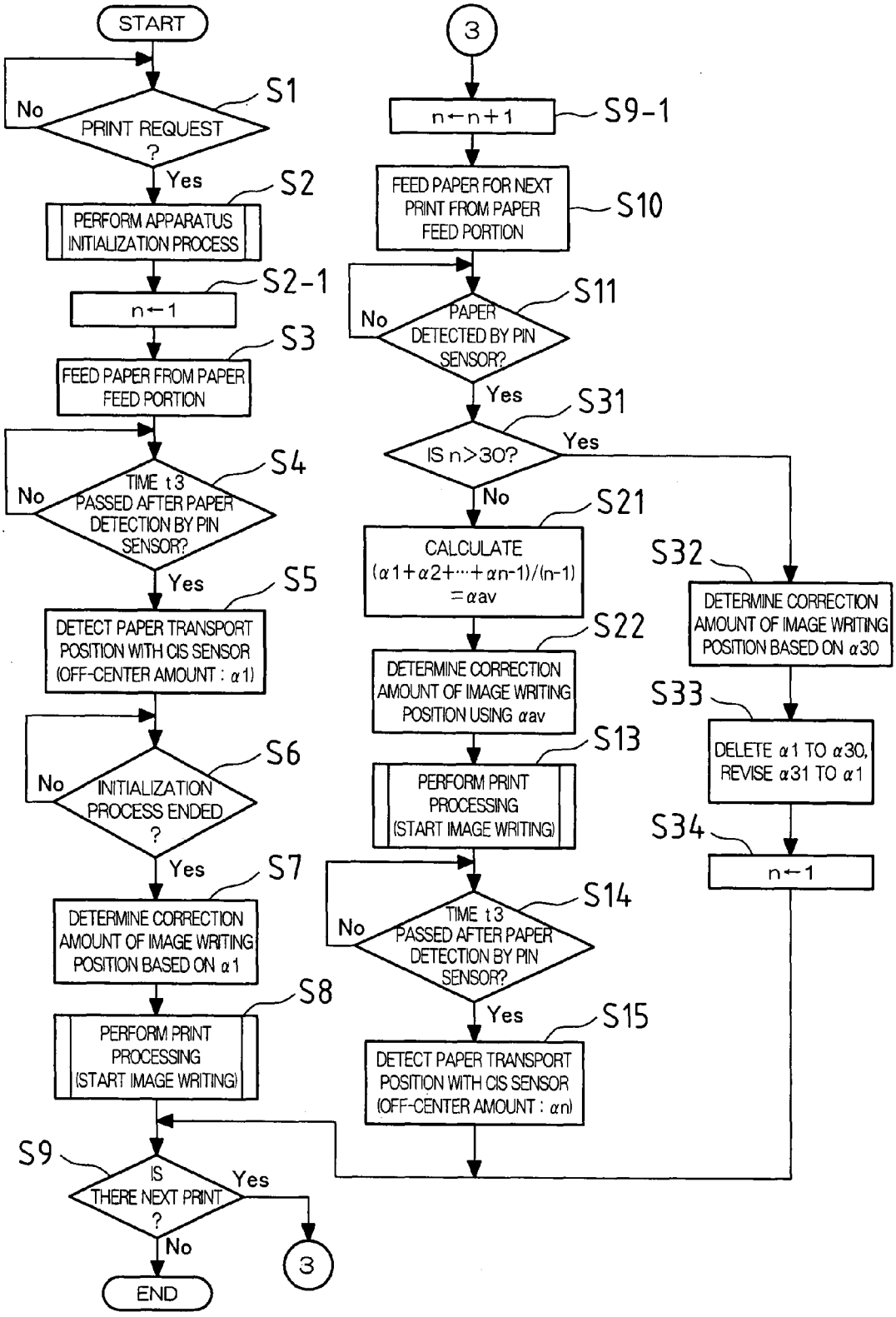
FIG. 12 is a flowchart that illustrates processing to correct an image writing position according to Example 3.

As shown in FIG. 12, when the image forming apparatus 1 is started up, and due to operation of the operation panel 10 a print request is received for consecutive print processing to a plurality of sheets of paper (Yes in Step S1), the control portion 101 starts a device initialization process (related to image forming processing)(Step S2).

At this time, the control portion 101, after setting n indicating the number of transported sheets of paper to 1 (Step S2-1), feeds one sheet of paper from one of the paper feed cassettes 26 (Step S3), and transports that sheet of paper in the direction of the photosensitive drum 14 with the transport rollers R31 and R32 via the shared transport path 28, and that paper is stopped with the trailing edge of the paper held sandwiched by the pre-registration rollers R41 and R42, and the leading edge of the paper making contact with the registration rollers R51 and R52. After the paper transported in the direction of the photosensitive drum 14 at this time is detected by the paper detection portion 71 (PIN sensor), the leading edge of the paper arrives at the registration rollers R51 and R52. At this time, when the time t3 passes after paper detection by the paper detection portion 71 (PIN sensor)(when judged Yes in Step S4), an off-center amount $\alpha 1$ is measured by detecting the paper transport position in the paper transport path for the first sheet of paper with the paper transport position detection portion 70 (CIS sensor configured from the light emitting portion 70*a* and the light receiving portion 70*b* of a line sensor)(Step S5), and the off-center amount $\alpha 1$ is stored in the memory 104. In this state, the initialization process of the apparatus ends (Yes in Step S6).

When the initialization process of the apparatus ends, the control portion 101 determines the correction amount of the position of image writing to the photosensitive drum 14 for the first sheet of paper such that the image writing position of the image information that has been made visible on the photosensitive drum 14 matches the paper transport position of the first sheet of paper stopped by the registration rollers R51 and R52, based on the off-center amount $\alpha 1$(Step S7). Specifically, the correction amount is obtained from $\beta 1=\beta 0+\alpha 1$.

After above Step S7, the control portion 101 starts print processing (Step S8). More specifically, the control portion 101 performs correction of the image writing position based on the correction amount determined above, and resumes driving of the registration rollers R51 and R52 and the pre-registration rollers R41 and R42 based on the image writing position after correction to start transport of the first sheet of paper in order to perform image forming (print processing) on the first sheet of paper at the image forming position (see nip portion N1).

At the same time, the control portion 101 checks whether or not there is subsequent printing (Step S9), and when there is subsequent printing, the control portion, after incrementing n indicating the number of transported sheets of paper (Step S9-1), feeds the next sheet of paper (in this case, the second sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor)(Yes in Step S11), after paper detection by the PIN sensor, the control portion 101 checks whether or not the number of consecutively transported sheets of paper has exceeded the 30 sheets of one division (Step S31), and when the number of consecutively transported sheets of paper has not exceeded the 30 sheets of one division (when judged No in Step S31), the control portion 101, using the off-center amount $\alpha 1$ of the prior sheet of paper, calculates $\alpha av=\alpha 1/1$ (Step S21), and based on the result of that calculation $\alpha av$ (in this case, $\alpha 1$), determines the correction amount of the position of image writing to the photosensitive drum 14 for the second sheet of paper such that the image writing position of the image information that has been made visible on the photosensitive drum 14 matches the paper transport position of the second sheet of paper (Step S22). Specifically, the correction amount is obtained from $\beta n=\beta 0+\alpha av$. Then, the control portion 101 performs correction of the image writing position based on the correction amount determined in Step S22, and transports the second sheet of paper based on the image writing position after correction in order to perform image forming (print processing) on the second sheet of paper at the image forming position (see nip portion N1), and performs correction of the image writing position based on the correction amount (specifically, correction amount $\beta n=\beta 0+\alpha n-1$) determined in Step S22. The control portion 101 starts print processing for the second sheet of paper based on the image writing position after correction (Step S13).

After print processing is started for the second sheet of paper, that paper is temporarily stopped with the trailing edge of the paper held sandwiched by the pre-registration rollers R41 and R42, and the leading edge of the paper making contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the second sheet of paper with the paper transport position detection portion 70 (CIS sensor configured from the light emitting portion 70*a* and the light receiving portion 70*b* of a line sensor)(Step S15), and this off-center amount $\alpha n(n=2)$ is stored in the memory 104.

After the off-center amount $\alpha n(n=2)$ is stored in the memory 104, the control portion 101 checks whether or not there is subsequent printing (Step S9), and when there is subsequent printing, the control portion 101 feeds the next sheet of paper (in this case, the third sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor) (Yes in Step S11), after paper detection by the PIN sensor, the control portion 101 checks whether or not the number of consecutively transported sheets of paper has exceeded the 30 sheets of one division (Step S31), and when the number of consecutively transported sheets of paper has not exceeded the 30 sheets of one division (when judged No in Step S31), the control portion 101, using all of the offset amounts $\alpha 1$ and $\alpha 2$ up to the previous sheet of paper, calculates $\alpha av=(\alpha 1+\alpha 2)/2$ (Step S21), and based on this average value $\alpha av$, determines the correction amount of the position of image writing to the photosensitive drum 14 for the third sheet of paper such that the image writing position of the image information that has been made visible on the photosensitive drum 14 matches the paper transport position of the third sheet of paper (Step S22). Specifically, the correction amount is obtained from $\beta n=\beta 0+\alpha av$. Then, the control portion 101 performs correction of the image writing position based on the correction amount determined in Step S22, and transports the third sheet of paper based on the image writing position after correction in order to perform image forming (print processing) on the third sheet of paper at the image forming position (see nip portion N1), and performs correction of the image writing position based on the correction amount (specifically, correction amount $\beta n=\beta 0+\alpha n-1$) determined in Step S22. The control portion 101 starts print processing for the third sheet of paper based on the image writing position after correction (Step S13).

After print processing is started for the third sheet of paper, that paper is temporarily stopped with the trailing edge of the paper held sandwiched by the pre-registration rollers R41 and R42, and the leading edge of the paper making contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the third sheet of paper with the paper transport position detection portion 70 (CIS sensor configured from the light emitting portion 70*a* and the light receiving portion 70*b* of a line sensor)(Step S15), and this off-center amount $\alpha n(n=3)$ is stored in the memory 104.

In the manner described above, the control portion 101 repeats the processing of above Steps S9 to S31 to further execute print processing for the fourth and subsequent sheets of paper. Specifically, the control portion 101 executes print processing for the second and subsequent sheets of paper by repeating the processing of above Steps S9 to S31, and in Step S21, by calculating $\alpha av=(\alpha 1+\alpha 2+\ldots+\alpha n-1)/(n-1)$ for each successive sheet of paper using all of the offset amounts $\alpha 1$, $\alpha 2$, . . . , $\alpha n-1$ up to the previous sheet of paper, print processing is executed for the second and subsequent sheets of paper. When, in such repetition of the processing of Steps S9 to S31, the control portion 101 has confirmed that the number of consecutively transported sheets of paper has exceeded the 30 sheets of one division (when judged Yes in Step S31), i.e., in the case of the 31st consecutively transported sheet of paper, the control portion 101, based on the detection value $\alpha 30$ for the immediately previous 30th sheet of paper, determines the correction amount of the position of image writing to the photosensitive drum 14 for the 31st sheet of paper such that the image writing position of the image information that has been made visible on the photosensitive drum 14 matches the leading edge of the paper stopped by the registration rollers R51 and R52 (Step S32). Specifically, the correction amount is obtained from $\beta 31=\beta 0+\alpha 30$. That is, the processing in Step S32 treats the 31st sheet in actuality as the first sheet of a new division, and in that sense is the same as the processing in Step S6.

Afterward, the past history $\alpha 1$ to $\alpha 30$ stored in the memory 104 is deleted (Step S33), and after changing the symbol of the presently stored off-center amount $\alpha 31$ to $\alpha 1$ (that is, after changing only the symbol and retaining the detection value as-is), n indicating the number of transported sheets of paper is initialized to 1 (Step S34), and processing returns to Step S9. Thus, the correction amount of the position for image writing to the photosensitive drum 14 is sequentially determined for the next division of 30 pages in the same manner as for the previous division of 30 pages.

In the manner described above, in Example 3, the calculation processing of above Example 2 is executed while initializing for each division of a number of sheets that has been set in advance (30 sheets in this example). More specifically, the detection values of the paper transport position of that sheet of paper when transported to the registration rollers R51 and R52 are not actually used; all detection values of all sheets of paper up to the previous sheet of paper in the same division are used, so even before that sheet of paper is transported to the registration rollers R51 and R52, it is possible to determine the transport restart timing for that sheet of paper. Thus, for example, even in high speed transfer in which about two sheets of A4 landscape paper are transported in one second, it is possible to easily and reliably determine, with time to spare, the correction amount of the image writing position for paper that is temporarily stopped by the registration rollers R51 and R52.

EXAMPLE 4

In above Examples 1 to 3, the processing was for one print request, i.e. processing of one job, but Example 4 is an example of a case of consecutive print requests, i.e. a case in which a plurality of jobs are consecutively executed. More specifically, ordinarily, there is a possibility that paper size and the paper feed cassette used will be different for different print requests. Therefore, in consideration of such a case, processing is completed for each single print request in above Examples 1 to 3.

Figure 13:
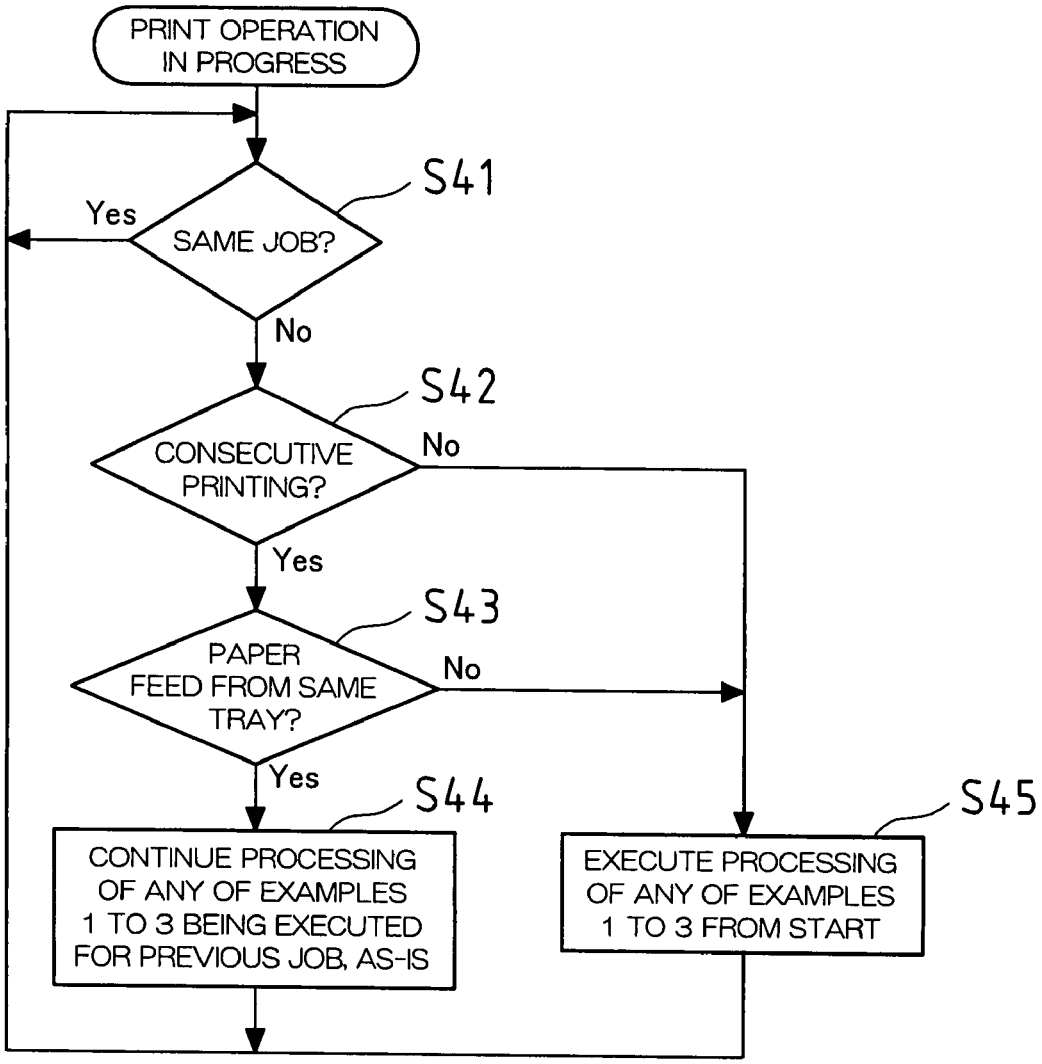
FIG. 13 is a flowchart that illustrates processing to correct an image writing position according to Example 4.

However, when there are a plurality of print requests, the plurality of print requests are consecutively processed without stopping operation of the apparatus, and in a case in which the same paper feed cassette is used, no problem will occur when the processing of above Examples 1 to 3 is continuously executed as-is for consecutive print requests. Example 4 is made in consideration of this point. Following is a description of processing to correct the image writing position according to Example 4, with reference to the flowchart shown in FIG. 13.

When a plurality of print requests are made, the control portion 101 constantly monitors whether or not the present print processing is print processing of the same print request, i.e., the same job (Step S41). Then, when print processing of one job ends and print processing of the next job is executed, the control portion 101 checks whether or not the processing of the next job is consecutive printing executed consecutively without stopping the apparatus (Step S42), and when the processing is consecutive printing (when judged Yes in Step S42), next the control portion 101 checks whether or not the paper tray that feeds paper is the same paper tray that was used in the immediately previous job (Step S43).

When the result of that check is that the paper tray is the same (when judged Yes in Step S43), the control portion 101 continuously executes, as-is, the processing of any of above Examples 1 to 3 (any of the processing in FIGS. 4 to 6) that was executed for the immediately previous job (Step S44).

On the other hand, when the processing is not for consecutive printing (No in Step S42), and the paper tray is not the same (No in Step S43), the processing of any of above Examples 1 to 3 is executed from the start for the next print request (Step S45). That is, in Step 45 the image forming processing of the image forming apparatus 1 is initialized.

EXAMPLE 5

When consecutively printing at high speed, it is possible that the registration rollers R51 and R52 will expand due to heat generated by friction or the like between with paper that has passed through the nip portion N5 of the registration rollers R51 and R52. It is possible that due to the expansion or the like, the paper transport position of paper held sandwiched by the registration rollers R51 and R52 will change greatly after a particular point in time. Example 5 is made in consideration of this point. In Example 5, a difference value of detection values of the paper transport position of two sheets of paper transported consecutively is continuously obtained for each two sheets of paper, and when that difference value has exceeded a permissible value that has been set in advance, in the processing to correct the image writing position according to any of above Examples 1 to 4, the processing to calculate an average value is initialized. Here, the permissible value is obtained by testing or the like in advance, in consideration of heat produced by rotational friction of the registration rollers R51 and R52, thermal expansion properties of the rollers due to an increase in the internal temperature of the apparatus, and the like.

Figure 14:
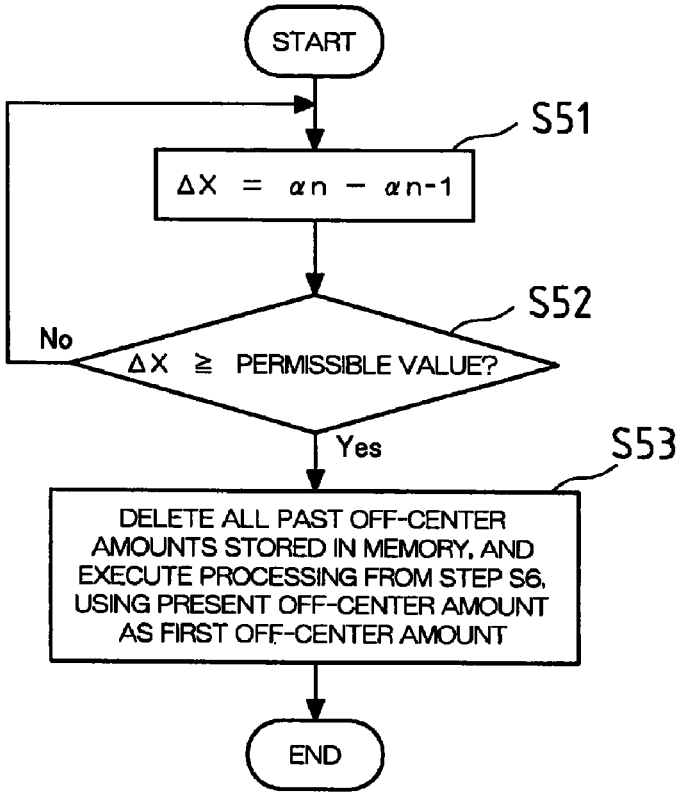
FIG. 14 is a flowchart that illustrates processing to correct an image writing position according to Example 5.

Following is a description of processing to correct the image writing position according to Example 5, with reference to the flowchart shown in FIG. 14. In Example 5, the processing below is executed parallel to the processing to correct the image writing position according to above Example 2 or Example 3.

More specifically, in the processing in Step S15 to correct the image writing position according to above Example 2 or Example 3, when the paper transport position of paper held sandwiched by the registration rollers R51 and R52 is detected by the paper transport position detection portion 70, a difference value $\Delta X$ between the off-center amount $\alpha n$ of that sheet of paper and the off-center amount $\alpha n-1$ of the immediately previous sheet of paper is obtained (Step S51), and that difference value $\Delta X$ is compared to a permissible value X1 that has been set in advance (Step S52). When $\Delta X$ is not greater than the permissible value X1, i.e., when $\Delta X$ is within the range of the permissible value X1 (when judged Yes in Step S52), processing from Step S15 onward is executed as-is.

On the other hand, when $\Delta X$ is greater than the permissible value X1, (when judged No in Step S52), processing is executed beginning from Step S6. More specifically, initialization is performed by deleting all of the past off-center amounts $\alpha 1, \alpha 2, \ldots, \alpha n-1$ that are stored in the memory 104 up to that point in time, and the transport restart timing determination processing is continued from Step S6, using the present off-center amount $\alpha n$ as a new, first sheet detection value.

Thus, even when there is suddenly a great change in the paper transport position due to heat or the like produced by the registration rollers, it is possible to immediately respond to this situation, so that the transport restart timing can be precisely determined.

EXAMPLE 6

In above Examples 1 to 5, the correction amount of the image writing position of the next transported sheet of paper is determined using the past off-center amount $\alpha n$, but in this sort of determination method, there is the condition that the transported sheets of paper are the same size. That is, when the paper feed cassette has been switched during print processing, at that point in time there is a possibility that the transported paper size is changed, so in such a case, the past off-center amount $\alpha n$ no longer has any meaning. Example 6 is made in consideration of this point. In Example 6, when the paper feed portion has been changed during consecutive print processing to a plurality of sheets of paper (for example, such as a case in which the paper feed portion has been changed from a paper feed cassette 26 to the LCC 60), the image forming processing of the image forming apparatus 1 is initialized, and correction of the image writing position of the paper transported from the paper feed portion (the first sheet of paper after the change) is performed for the paper feed portion after the change. Also, when the paper feed portion has been updated during consecutive print processing to a plurality of sheets of paper (for example, such as a case in which a setting is made to store paper in a paper feed cassette 26), the image forming processing of the image forming apparatus 1 is initialized, and correction of the image writing position of the paper transported from the paper feed portion (the first sheet of paper after updating) is performed for the paper feed portion after updating. Specifically, when the paper feed cassette has been switched during print processing of one job, in the transport restart timing determination processing according to any of above Examples 1 to 5, the processing to calculate an average value is initialized.

Figure 15:
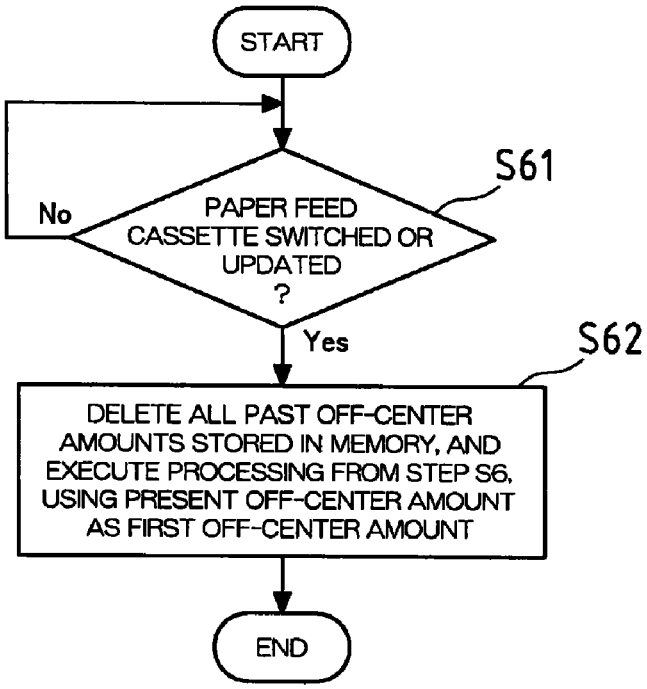
FIG. 15 is a flowchart that illustrates processing to correct an image writing position according to Example 6.

Following is a description of processing to correct the image writing position according to Example 6, with reference to the flowchart shown in FIG. 15. In Example 6, the processing below is executed parallel to the processing to correct the image writing position according to any of above Examples 1 to 5.

Specifically, the control portion 101 monitors whether or not the paper feed cassette has been switched during the processing to correct the image writing position according to any of the above Examples 1 to 5 (Step S61). As for the switching of the paper feed cassette, for example, there may be a case in which a switch is made to one of the four paper feed cassettes 26 installed so as to be removable from the front face side of the image forming apparatus 1, or a case in which a switch is made from these paper feed cassettes to the large capacity cassette (LCC) 60, or a case in which a switch is made to any of unshown paper feed cassettes within the large capacity cassette (LCC) 60. Also, with respect to updating of the paper feed cassette, for example, there may be a case in which paper is fed by opening a paper feed cassette 26 installed so as to be removable from the front face side of the image forming apparatus 1, or a case in which paper is fed by opening any of the unshown paper feed cassettes within the large capacity cassette (LCC) 60.

When the control portion 101 detects this sort of switching or updating of the paper feed cassette, (when judged Yes in Step S61), initialization is performed by deleting all of the past off-center amounts $\alpha 1, \alpha 2, \ldots, \alpha n-1$ that are stored in the memory 104 up to that point in time, and the transport restart timing determination processing is continued from Step S6, using the present off-center amount $\alpha n$ as a new, first sheet detection value.

Thus, even when the paper feed cassette has been switched or updated during print processing, it is possible to immediately respond to this situation, so that the transport restart timing can be precisely determined.

According to Example 6, when the paper feed portion has been changed during consecutive print processing to a plurality of sheets of paper, the image forming processing of the image forming apparatus is initialized, and correction of the image writing position of the paper transported from the paper feed portion is performed for the paper feed portion after the change. Thus, it is possible to set the image forming position of the paper for each of the plurality of paper feed portions, and so it is possible to increase the: precision of the image forming position of the paper independently for each of the paper feed portions.

Also, when the paper feed portion has been updated during consecutive print processing to a plurality of sheets of paper (for example, installation or removal of a paper feed portion such as when feeding paper to the paper feed portion), the image forming processing of the image forming apparatus is initialized, and correction of the image writing position of the paper transported from the paper feed portion is performed for the paper feed portion after the change. Thus, even when a paper feed portion has been updated, displacement of the image forming position of the paper that accompanies updating is eliminated, and so it is possible to increase the precision of the image forming position of the paper independently for each of the paper feed portions.

EXAMPLE 7

In above Examples 1 to 5, the correction amount of the image writing position of the next transported sheet of paper is determined using the past off-center amount $\alpha n$, but in this sort of determination method, there is the condition that the printing operation is consecutive. Specifically, when the print processing operation in a single job has been interrupted, in order to execute processing beginning from the initialization process for the image forming processing when restarting printing, in such a case, for example, as in the case of the cassette switching of above Example 6, initialization is performed by deleting all of the past off-center amounts $\alpha 1$, $\alpha 2$, . . . , $\alpha n-1$ that are stored in the memory 104 up to that point in time, and processing is executed beginning from the initialization process of Step S2.

EXAMPLE 8

Above Examples 1 to 7, while not particularly limited, are examples of a case in which the printing mode is for simplex printing. However, the printing mode includes a duplex printing mode in addition to a simplex printing mode. Example 8 is an example of a case of duplex printing. With duplex printing, although the paper is the same, the contact state when held sandwiched by the registration rollers R51 and R52 will differ for initial paper with nothing printed on either side and paper in a state printed on one side. Therefore, there is a possibility that the paper transport position will be different when the paper is stopped in contact with the registration rollers R51 and R52. Thus, Example 8 was made in consideration of this point, and in Example 8, when the printing mode is for duplex printing, correction of the image writing position is determined for each print face of the paper (the front face and the back face) by executing the processing of any of above Examples 1 to 3 for each print face.

That is, the control portion 101 judges whether the paper transported to the registration rollers R51 and R52 during the print processing of one job is paper just fed from a paper feed cassette without anything printed on either face (paper for printing on the front face), or is paper that has already been printed on the front face, was fed with the leading and trailing edges of the paper in a reversed state by the re-feed roller 35 of the automatic duplex paper feed apparatus 23, and transported via the shared transport path 28 by the re-transport roller 36 in a state with the front and back faces reversed (paper for printing on the back face). Based on the results of this judgment, distinguishing between the case of printing on the front face and printing on the back face, the processing of any of the above Examples 1 to 7 is executed for each case. That is, in the case of printing on the front face, the transport restart timing is determined using only the detection value for front face printing detected by the paper transport position detection portion 70 when front side printing was performed and stored in the memory 104, and in the case of printing on the back face, the transport restart timing is determined using only the detection value for back face printing detected by the paper transport position detection portion 70 when back side printing was performed and stored in the memory 104. Thus, also in the case of duplex printing, it is possible to respond to the state of printing to paper (the case of front face printing and the case of back face printing), thus precisely determining the correction of the image writing position.

EXAMPLE 9

For example, in above Examples 2 and 3, the average value $\alpha av$ of all detection values is calculated using all of the off-center amounts $\alpha 1$, $\alpha 2$, . . . , $\alpha n-1$ detected by the paper transport position detection portion 70. However, for example, a case in which due to the state of paper feed to the paper feed cassette 26, only one sheet in the paper feed cassette 26 has been fed in a greatly displaced state, a case in which transport displacement of paper in the paper transport path has occurred during transport, or the like are conceivable. In these cases, it is likely that the detection value obtained by the paper transport position detection portion 70 for that paper differs greatly from other detection values. Thus, when that detection value that differs greatly from the other detection values is included in the average value $\alpha av$ of all detection values, the average value $\alpha av$ shifts toward the greatly differing detection value, resulting in poorer precision of the correction amount of the image writing position.

Consequently, in Example 9, the correction amount of the image writing position is limited to correction amounts that are within a range that has been set in advance, and a correction amount falling outside of the range that has been set in advance is excluded from the data for the average value. For example, the range of correction values is set to a maximum of ±0.5 mm.

With the above configuration, the precision of the data for the average value is increased by not adopting data with low reliability in the data for the average value, and as a result, it is possible to increase the precision of the image forming position on the paper.

Incidentally, in above Examples 1 to 9 of the present embodiment, during consecutive print processing to a plurality of sheets of paper, paper is transported from a paper feed portion to the image forming position after starting consecutive print processing, but this is not a limitation; paper may be transported to the image forming position prior to the consecutive print processing.

Consequently, following is a description of an embodiment in which paper is transported to the image forming position prior to the consecutive print processing.

Second Embodiment

The image forming apparatus 1 according to Embodiment 2 is described with reference to the drawings (in particular, FIGS. 16 to 18). The image forming apparatus 1 according to Embodiment 2 differs from Embodiment 1 in the configuration with which the paper is transported from a paper feed portion to the image forming position. In Embodiment 2, aspects of the configuration differing from Embodiment 1 including above Examples 1 to 9, are described, and a description of aspects of the configuration that are the same as in Embodiment 1 is omitted here. Therefore, working effects and modified examples obtained by aspects of the configuration that are the same as in Embodiment 1 are the same in Embodiment 2, and a description of these same working effects and modified examples is omitted here.

In the image forming apparatus according to Embodiment 2, same as in Embodiment 1 including above Examples 1 to 9, a paper feed portion is selected from among the plurality of paper feed portions 26 in order to perform image writing, a plurality of sheets of paper are transported from the selected paper feed portion to the image forming position, and consecutive print processing to the plurality of sheets of paper is performed. In the present embodiment, paper is transported from the selected paper feed portion to the image forming position prior to consecutive print processing to the plurality of sheets of paper.

Specifically, prior to consecutive print processing, i.e., prior to image writing, paper from the selected paper feed portion (for example, the uppermost paper feed cassette 26 shown in FIG. 1) is picked up by the paper feed roller 27 and transported to the image forming position via the shared transport path 28, and at the image forming position the paper is stopped (waiting) in a state held sandwiched by the pre-registration rollers R41 and R42, and the registration rollers R51 and R52.

The selection of a paper feed portion from among the plurality of paper feed portions in the present embodiment is performed based on the original size and magnification setting of the image for which image writing is to be performed. Alternatively, the image forming apparatus 1 is connected to an external device such as a PC via a LAN or the like, and the above selection is made based on the content of an instruction input remotely from this external device. Alternatively, the above selection is made based on the content of an instruction that has been input from an operation means (such as the operation panel 10 shown in FIG. 3) whereby a user performs external input. The selection of a paper feed portion referred to here includes selection of a paper feed portion updated when updating a paper feed portion. Also, updating of a paper feed portion refers to changing settings of a paper feed portion (resetting) when information has changed with respect to paper stored in the paper feed portion, such as changing or replenishing the paper stored in the paper feed portion. For example, this refers to removal of a paper feed portion in order to replenish that paper feed portion with paper when there is no more paper remaining in the paper feed portion.

Below is a description of specific examples (Examples 10 to 12) of correction of the image writing position for image forming on paper, and transport of paper to the image position prior to consecutive print processing, by the image forming apparatus 1 according to Embodiment 2.

EXAMPLE 10

Figure 16:
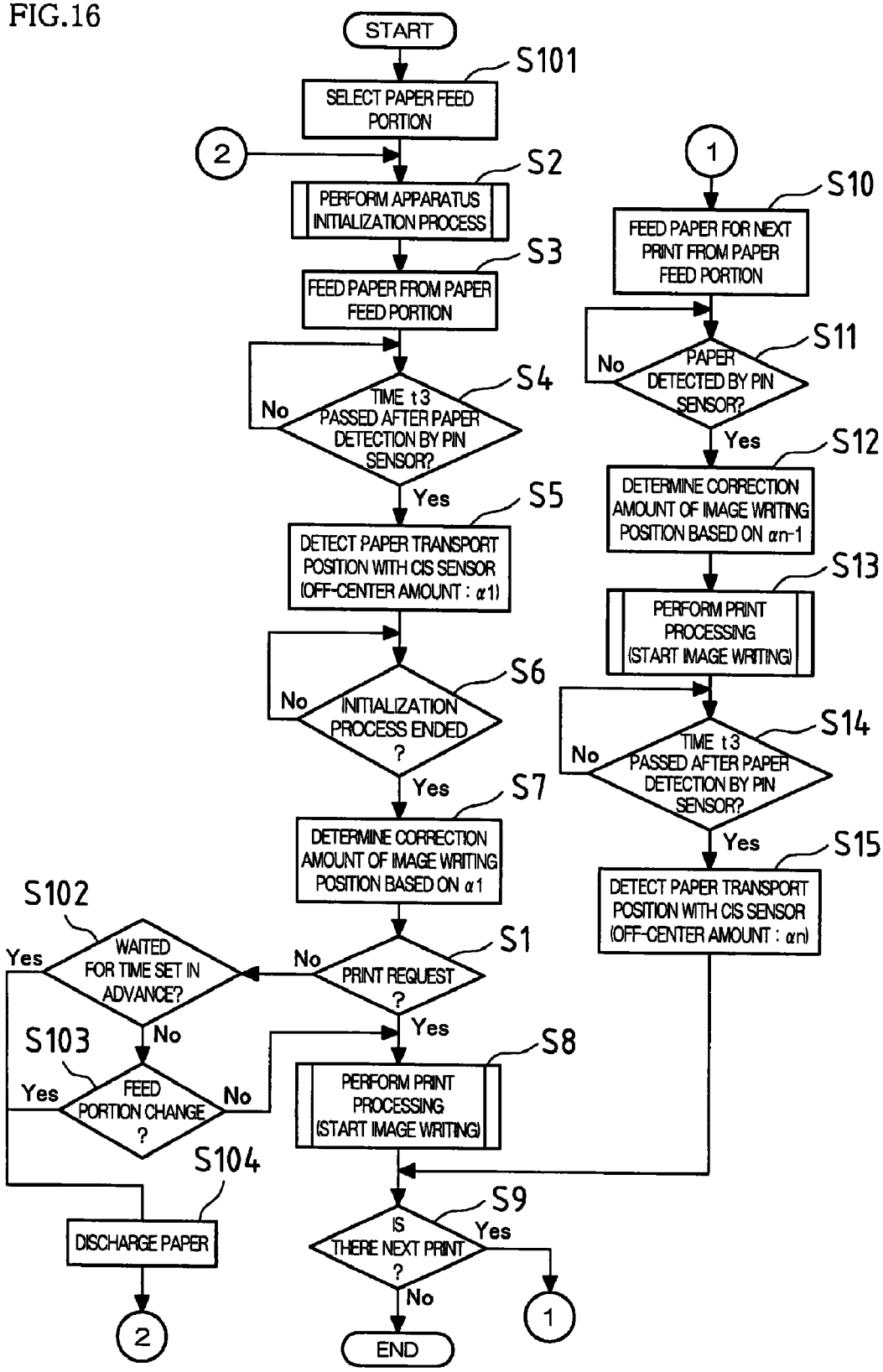
FIG. 16 is a flowchart that illustrates processing to correct an image writing position according to Example 10, and a process of transporting paper to an image position before consecutive print processing.
Figure 17:
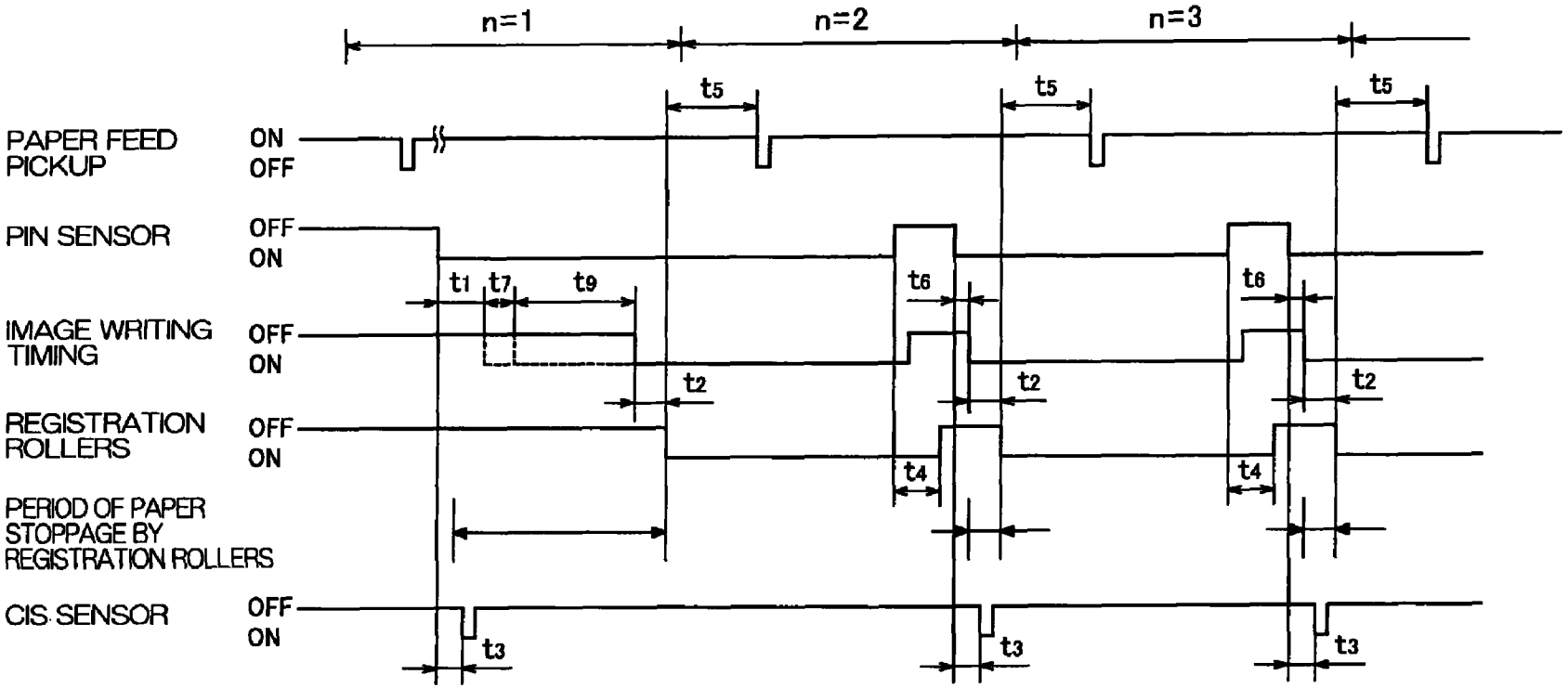
FIG. 17 is a timing chart of a case when, during a time that does not exceed a time that was set in advance in Step S102 shown in FIG. 16, there is no change in a paper feed portion in Step S103.
Figure 18:
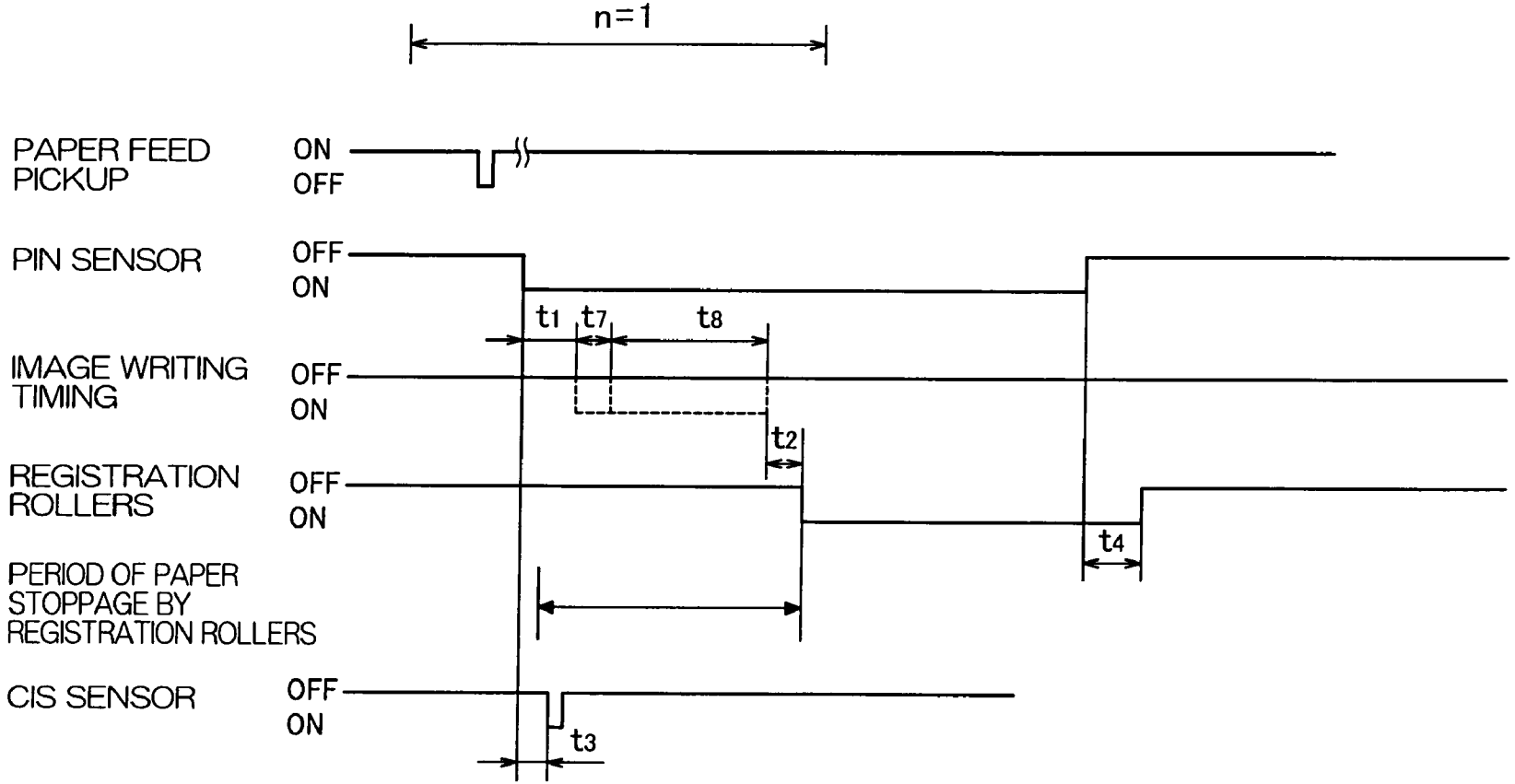
FIG. 18 is a timing chart of a case in which a time that was set in advance is exceeded in Step S102 shown in FIG. 16.

Following is a description of correction of the image writing position for image forming on paper, and transport of paper to the image position prior to consecutive print processing, by the image forming apparatus 1 according to Embodiment 2, with reference to FIGS. 16 to 18.

It is necessary that the initial setting of the image forming position of the image forming apparatus 1 is performed individually for each of the plurality of paper feed portions. So, the paper transport position $\alpha 0$ and the reference adjustment amount $\beta 0$ are set individually for each of the plurality of paper feed portions by the aforementioned initial setting. The processing to correct the image writing position during ordinary use described below is executed using the paper transport position $\alpha 0$ and the reference adjustment amount $\beta 0$ that have been set corresponding to the paper feed portion that feeds paper during print processing. Also, when re-printing in the duplex printing mode (printing to the back face), the correction processing is executed using the paper transport position $\alpha 0$ and the reference adjustment amount $\beta 0$ that have been set for the automatic duplex paper feed apparatus 23.

First, as shown in FIG. 16, when the image forming apparatus 1 is started up in order to perform image writing, a user performs the above selection of a paper feed portion (Step S101), and the control portion 101 starts the initialization process of the apparatus (with respect to image forming processing)(Step S2). Alternatively, the user performs updating of the paper feed portion (Step S101), and the control portion 101 starts the initialization process of the apparatus (with respect to image forming processing)(Step S2). For example, an apparatus initialization process of, namely, adjusting the charging potential provided by the charging unit 15, or removal of toner stains on the surface of the photosensitive drum 14 by the cleaner 18, is started. Also, in Example 10, in Step S101, the uppermost paper feed cassette 26 shown in FIG. 1 is selected.

Afterward, the control portion 101 feeds a sheet of paper from the selected paper feed cassette 26 to the image writing position (Step S3), and transports that sheet of paper in the direction of the photosensitive drum 14 with the transport rollers R31 and R32 via the shared transport path 28, and that paper is stopped with the trailing edge of the paper held sandwiched by the pre-registration rollers R41 and R42, and the leading edge of the paper making contact with the registration rollers R51 and R52. After the paper transported in the direction of the photosensitive drum 14 at this time is detected by the paper detection portion 71 (PIN sensor), the leading edge of the paper arrives at the registration rollers R51 and R52. At this time, when the time t3 passes after paper detection by the paper detection portion 71 (PIN sensor)(when judged Yes in Step S4), the off-center amount $\alpha 1$ is measured by detecting the paper transport position in the paper transport path for the first sheet of paper with the paper transport position detection portion 70 (CIS sensor configured from the light emitting portion 70*a* and the light receiving portion 70*b* of a line sensor)(Step S5), and the off-center amount $\alpha 1$ is stored in the memory 104. As shown in FIG. 7, the off-center amount $\alpha 1$ indicates the distance between the paper transport position $\alpha 0$ at the time of the initial setting and the presently measured paper transport position. In this state, the initialization process of the apparatus ends (Yes in Step S6).

When the initialization process of the apparatus ends, the control portion 101 determines the correction amount of the position of image writing to the photosensitive drum 14 for the first sheet of paper such that the image writing position of the image information that has been made visible on the photosensitive drum 14 matches the paper transport position of the first sheet of paper stopped by the registration rollers R51 and R52, based on the image writing position after correction (based on the off-center amount $\alpha 1$)(Step S7).

After the correction amount of the position of image writing to the photosensitive drum 14 is determined in Step S7, the apparatus waits for a print request for consecutive print processing to a plurality of sheets of paper by operation of the operation panel 10.

In the state waiting for a print request for consecutive print processing to a plurality of sheets of paper, when there is not a print request for consecutive print processing to a plurality of sheets of paper (No in Step S1), the apparatus waits continuously for a print request for a predetermined time (time t8 shown in FIG. 18)(Step S102). When the set time t8 is exceeded, the paper waiting at the image forming position is transported (discharged) to the discharge tray 33 (Step S104), and the apparatus is again initialized (Step S2). When there is a print request before exceeding the set time t8 in Step S102 (time t9 shown in FIG. 17), and also the selected paper feed cassette 26 is changed to another paper feed portion (Yes in Step S103), the paper waiting at the image forming position is transported (discharged) to the discharge tray 33 (Step S104), and the apparatus is again initialized (Step S2). When the paper feed portion is not changed in Step S103, the control portion 101 performs print processing using the selected paper feed cassette 26 (Step S8).

On the other hand, when there is a print request for consecutive print processing to a plurality of sheets of paper in Step S1, the control portion starts print processing using the selected paper feed cassette 26 (Step S8). Specifically, the control portion 101 performs correction of the image writing position based on the correction amount determined above (see FIG. 8), and resumes driving of the registration rollers R51 and R52 and the pre-registration rollers R41 and R42 based on the image writing position after correction to start transport of the first sheet of paper in order to perform image forming (print processing) on the first sheet of paper at the image forming position (see nip portion N1).

At the same time, the control portion 101 checks whether or not there is subsequent printing (Step S9), and when there is subsequent printing, the control portion feeds the next sheet of paper (in this case, the second sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor) (Yes in Step S11), after paper detection by the PIN sensor, the control portion 101 determines the correction amount of the position of image writing to the photosensitive drum 14 for the second sheet of paper such that the image writing position of the image information that has been made visible on the photosensitive drum 14 matches the paper transport position of the second sheet of paper, based on the image writing position after correction (based on the off-center amount $\alpha n-1$ of the prior sheet of paper)(Step S12). Then, the control portion 101 performs correction of the image writing position based on the correction amount determined in Step S12 (specifically, correction amount $\beta n=\beta 0+\alpha n-1$). The control portion 101 starts print processing for the second sheet of paper based on the image writing position after correction (Step S13).

After print processing is started for the second sheet of paper, that paper is temporarily stopped with the trailing edge of the paper held sandwiched by the pre-registration rollers R41 and R42, and the leading edge of the paper making contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the second sheet of paper with the paper transport position detection portion 70 (CIS sensor configured from the light emitting portion 70*a* and the light receiving portion 70*b* of a line sensor)(Step S15), and this off-center amount $\alpha n(n=2)$ is stored in the memory 104.

After the off-center amount $\alpha n(n=2)$ is stored in the memory 104, the control portion 101 checks whether or not there is subsequent printing (Step S9), and when there is subsequent printing, the control portion 101 feeds the next sheet of paper (in this case, the third sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor) (Yes in Step S11), after paper detection by the PIN sensor, the control portion 101 determines the correction amount of the position of image writing to the photosensitive drum 14 for the third sheet of paper such that the image writing position of the image information that has been made visible on the photosensitive drum 14 matches the paper transport position of the third sheet of paper, based on the image writing position after correction (based on the off-center amount $\alpha n-1$ of the prior sheet of paper)(Step S12). Then, the control portion 101 performs correction of the image writing position based on the correction amount determined in Step S12 (specifically, correction amount $\beta n=\beta 0+\alpha n-1$). The control portion 101 starts print processing for the second sheet of paper based on the image writing position after correction (Step S13).

After print processing is started for the third sheet of paper, that paper is temporarily stopped with the trailing edge of the paper held sandwiched by the pre-registration rollers R41 and R42, and the leading edge of the paper making contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the third sheet of paper with the paper transport position detection portion 70 (CIS sensor configured from the light emitting portion 70*a* and the light receiving portion 70*b* of a line sensor)(Step S15), and this off-center amount $\alpha n(n=3)$ is stored in the memory 104.

In the manner described above, the control portion 101 repeats the processing of above Steps S9 to S15 to further execute print processing for the fourth and subsequent sheets of paper.

The timing chart shown in FIGS. 17 and 18 shows, with respect to Example 10, the relationship between an ON/OFF state for a paper feed pickup detection, an ON/OFF state for paper detection by a PIN sensor (the paper detection portion 71), an ON/OFF state of write timing of image information by a laser to the photosensitive drum 14, an ON/OFF state for transport driving of the registration rollers R51 and R52, and an ON/OFF state for paper transport position detection of a CIS sensor (the paper transport position detection portion 70). Specifically, FIG. 17 is a timing chart that shows a case of, in the time t9 that does not exceed the time t8 set in advance in Step S102, a time of no updating of the paper feed portion in Step S103. FIG. 18 is a timing chart that shows a case of exceeding the time t8 set in advance in Step S102.

The times shown in FIGS. 17 and 18 are as follows. The time t1 indicates the time from paper detection by the PIN sensor until image writing is performed with no time in Step S102. The time t2 indicates the time from image writing until transport of paper by the registration rollers R51 and R52. The time t3 indicates the time from paper detection by the PIN sensor until paper transport position detection by the CIS sensor. The time t4 indicates the time from paper trailing edge detection by the PIN sensor until paper transport stoppage by the registration rollers R51 and R52 for the second and subsequent sheets of paper. The time t5 indicates the time from paper transport by the registration rollers R51 and R52 until start of paper pickup by the paper feed roller 27. The time t6 indicates the time from paper detection by the PIN sensor until image writing for the second and subsequent sheets of paper. The time t7 indicates the delay time relative to the time t1 due to initialization of the apparatus. The time t8 indicates the maximum time to wait for a print request (upper limit of time). The time t9 indicates the delay time relative to the time t1 until detecting a print request.

As described above, with the image forming apparatus 1 according to Example 10, not only are the same working effects as in above Examples 1 to 9 obtained, a plurality of paper feed portions that transport paper to the image forming position are provided, and prior to consecutive print processing to a plurality of sheets of paper transported to the image forming position from a paper feed portion (the selected paper feed portion 26 in Example 10) selected from among the plurality of paper feed portions in order to perform image writing, paper is transported from the selected paper feed portion (the selected paper feed portion 26 in Example 10) to the image forming position. Thus, in comparison to Examples 1 to 9 in which the first sheet of paper is fed after the print request, the first sheet of paper can be more quickly fed when performing consecutive print processing to a plurality of sheets of paper.

Also, in Example 10, when a paper feed portion has been updated, paper is transported to the image forming position from the updated paper feed portion prior to consecutive print processing, so the first sheet of paper can be more quickly fed when performing consecutive print processing to a plurality of sheets of paper using the updated paper feed portion.

Also, in Example 10, when a paper feed portion has been updated, the paper that has been transported to the image forming position prior to consecutive print processing is discharged to the discharge tray 33, so it is possible to avoid printing to undesired paper in a state in which the first sheet of paper is more quickly fed when performing consecutive print processing to a plurality of sheets of paper.

Also, in Example 10, paper that has been transported to the image forming position prior to consecutive print processing is discharged to the discharge tray 33 after the time t8 set in advance has passed, so it is possible to avoid printing to undesired paper in a state in which the first sheet of paper is more quickly fed when performing consecutive print processing to a plurality of sheets of paper.

Also, in Example 10, paper that has been transported to the image forming position prior to consecutive print processing is transported downstream from the image forming position in the paper transport path prior to consecutive print processing and then discharged to the discharge tray 33, so it is possible to avoid printing to undesired paper in a state in which the first sheet of paper is more quickly fed when performing consecutive print processing to a plurality of sheets of paper.

Also, in Example 10, when changing the selected paper feed portion, paper that has been transported to the image forming position is discharged to the discharge tray 33, but the paper may be simply used as cleaning paper and not discharged to the discharge tray 33. For example, prior to performing a process of removing toner stains from the surface of the photosensitive drum 14 with the cleaner 18, the paper may be transported outside of the image forming apparatus. In this case, paper that has been transported to the image forming position prior to consecutive print processing is discharged downstream from the image forming position in the paper transport path as cleaning paper, so it is possible to avoid printing to undesired paper in a state in which the first sheet of paper is more quickly fed when performing consecutive print processing to a plurality of sheets of paper, and the member that performs image forming can be cleaned. Furthermore, this configuration is preferable from the perspective of running cost.

Also, in Example 10, when changing the selected paper feed portion, or when the set time t8 has been exceeded in S102, paper that has been transported to the image forming position is discharged to the discharge tray 33, but this not a limitation; a configuration may be adopted in which the paper is transported outside of the image forming apparatus, such as the configuration disclosed below.

In the configuration of Example 10 described above, paper that has been transported to the image forming position prior to consecutive print processing may be discharged upstream from the image forming position in the paper transport path and returned to the paper feed portion that fed the paper. For example, when the selected paper feed portion is changed from the paper feed cassette 26 disposed uppermost in FIG. 1 to the paper feed cassette 26 disposed lowermost, by rotating the transport rollers R31 and R32, the pre-registration rollers R41 and R42, the registration rollers R51 and R52, and the paper feed roller 27 in the direction opposite to the ordinary direction, paper transported to the image forming position from the paper feed cassette 26 disposed uppermost prior to consecutive print processing is transported in the direction opposite to the ordinary transport direction and thus returned to the uppermost paper feed cassette 26.

Also, paper that has been transported to the image forming position prior to consecutive print processing may be transported to a paper feed portion other than the paper feed portion that fed the paper. Specifically, a spare paper feed portion (not shown) may be newly provided, with the paper that has been transported to the image forming position prior to consecutive print processing being transported to the spare paper feed portion. In this case, because the spare paper feed portion is newly provided, paper can be stored again, and it is possible to suppress the occurrence of a paper jam in the paper transport path when storing paper again.

Also, paper that has been transported to the image forming position prior to consecutive print processing may be transported to a re-feed portion for printing an image to both faces of the paper. Specifically, paper that has been transported to the image forming position prior to consecutive print processing may be transported to the automatic duplex paper feed apparatus 23 (referred to as a duplex paper feed apparatus in the present invention). Also, when the same paper feed portion has been selected for the next consecutive print processing, by using the paper transported to the automatic duplex paper feed apparatus 23 it is possible to suppress wasteful discharge of paper. Also, when the next consecutive print processing is duplex printing to paper, the paper transported to the automatic duplex paper feed apparatus 23 is discharged to the discharge tray 33 via the shared transport path 28.

According both Embodiments 1 and 2 as described above, it is possible to avoid printing to undesired paper in a state in which the first sheet of paper is more quickly fed when performing consecutive print processing to a plurality of sheets of paper, and it is possible to suppress wasteful discharge of paper.

Of course, it is also possible to use above Examples 1 to 10 of Embodiments 1 and 2 in a suitable combination, and as a result, the characteristic working effects of the respective examples will be together obtained by such a combination. For example, a configuration applying the content of Examples 2 and 3 in the configuration of Example 10 is disclosed in Examples 11 and 12 below.

EXAMPLE 11

Figure 19:
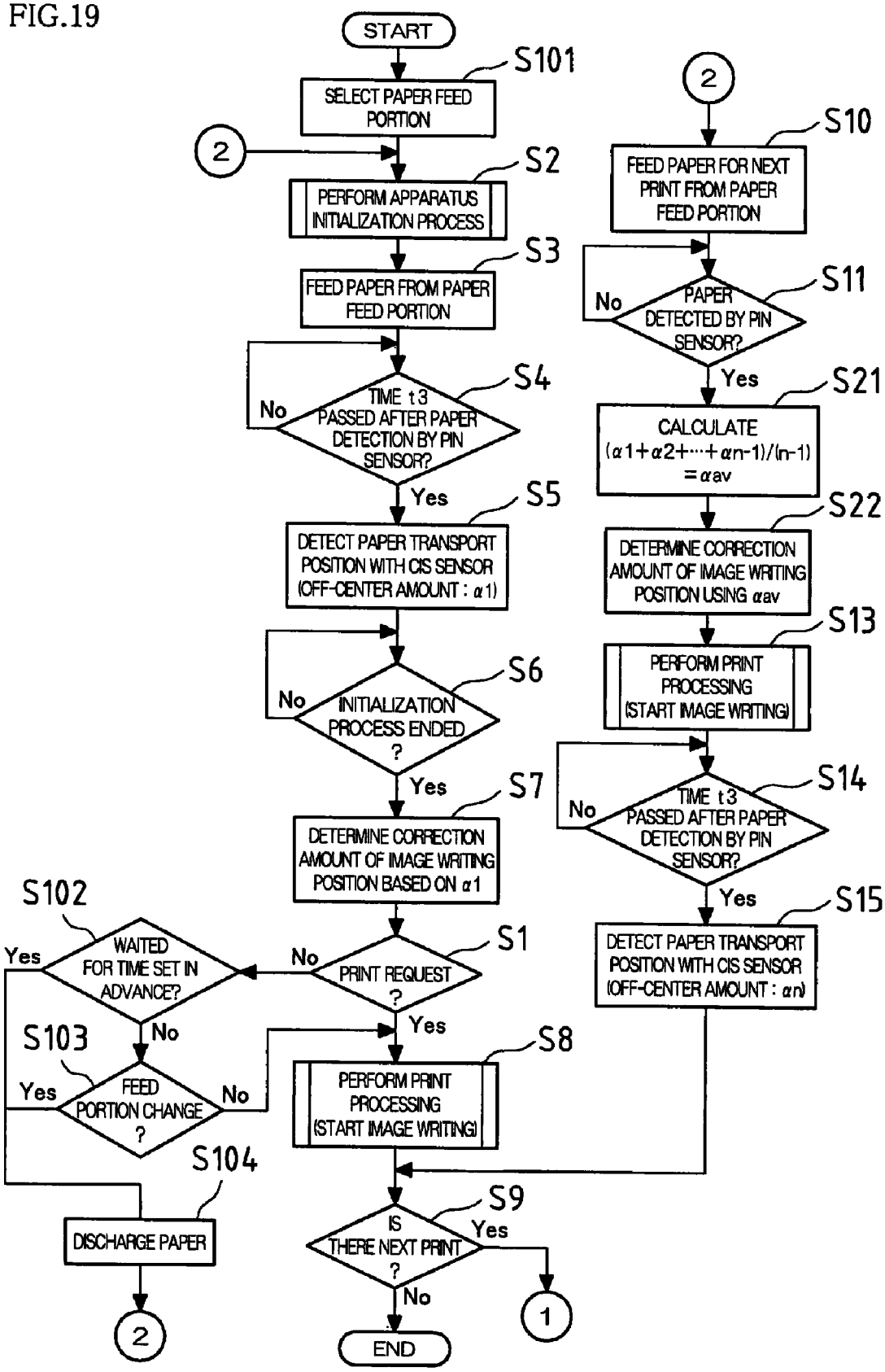
FIG. 19 is a flowchart that illustrates processing to correct an image writing position according to Example 11, and a process of transporting paper to an image position before consecutive print processing.

As shown in FIG. 19, when the image forming apparatus 1 is started up in order to perform image writing, a user performs the above selection of a paper feed portion (Step S101), and the control portion 101 starts the initialization process of the apparatus (with respect to image forming processing) (Step S2). Alternatively, the user performs updating of the paper feed portion (Step S101), and the control portion 101 starts the initialization process of the apparatus (with respect to image forming processing)(Step S2). For example, an apparatus initialization process of, namely, adjusting the charging potential provided by the charging unit 15, or removal of toner stains on the surface of the photosensitive drum 14 by the cleaner 18, is started. Also, in Example 11, in Step S101, the uppermost paper feed cassette 26 shown in FIG. 1 is selected.

Afterward, the control portion 101 transports a sheet of paper from the selected paper feed cassette 26 to the image writing position (Step S3), and transports that sheet of paper in the direction of the photosensitive drum 14 with the transport rollers R31 and R32 via the shared transport path 28, and that paper is stopped with the trailing edge of the paper held sandwiched by the pre-registration rollers R41 and R42, and the leading edge of the paper making contact with the registration rollers R51 and R52. After the paper transported in the direction of the photosensitive drum 14 at this time is detected by the paper detection portion 71 (PIN sensor), the leading edge of the paper arrives at the registration rollers R51 and R52. At this time, when the time t3 passes after paper detection by the paper detection portion 71 (PIN sensor)(when judged Yes in Step S4), the off-center amount $\alpha 1$ is measured by detecting the paper transport position in the paper transport path for the first sheet of paper with the paper transport position detection portion 70 (CIS sensor configured from the light emitting portion 70*a* and the light receiving portion 70*b* of a line sensor)(Step S5), and the off-center amount $\alpha 1$ is stored in the memory 104. As shown in FIG. 7, the off-center amount $\alpha 1$ indicates the distance between the paper transport position $\alpha 0$ at the time of the initial setting and the presently measured paper transport position. In this state, the initialization process of the apparatus ends (Yes in Step S6).

When the initialization process of the apparatus ends, the control portion 101 determines the correction amount of the position of image writing to the photosensitive drum 14 for the first sheet of paper such that the image writing position of the image information that has been made visible on the photosensitive drum 14 matches the paper transport position of the first sheet of paper stopped by the registration rollers R51 and R52, based on the image writing position after correction (based on the off-center amount $\alpha 1$)(Step S7).

After the correction amount of the position of image writing to the photosensitive drum 14 is determined in Step S7, the apparatus waits for a print request for consecutive print processing to a plurality of sheets of paper by operation of the operation panel 10.

In the state waiting for a print request for consecutive print processing to a plurality of sheets of paper, when there is not a print request for consecutive print processing to a plurality of sheets of paper (No in Step S1), the apparatus waits continuously for a print request for a predetermined time (time t8 shown in FIG. 18)(Step S102). When the set time t8 is exceeded, the paper waiting at the image forming position is transported (discharged) to the discharge tray 33 (Step S104), and the apparatus is again initialized (Step S2). When there is a print request before exceeding the set time t8 in Step S102 (time t9 shown in FIG. 17), and also the selected paper feed cassette 26 is changed to another paper feed portion (Yes in Step S103), the paper waiting at the image forming position is transported (discharged) to the discharge tray 33 (Step S104), and the apparatus is again initialized (Step S2). When the paper feed portion is not changed in Step S103, the control portion 101 performs print processing using the selected paper feed cassette 26 (Step S8).

On the other hand, when there is a print request for consecutive print processing to a plurality of sheets of paper in Step S1, the control portion starts print processing using the selected paper feed cassette 26 (Step S8). Specifically, the control portion 101 performs correction of the image writing position based on the correction amount determined above (see FIG. 8), and resumes driving of the registration rollers R51 and R52 and the pre-registration rollers R41 and R42 based on the image writing position after correction to start transport of the first sheet of paper in order to perform image forming (print processing) on the first sheet of paper at the image forming position (see nip portion N1).

At the same time, the control portion 101 checks whether or not there is subsequent printing (Step S9), and when there is subsequent printing, the control portion feeds the next sheet of paper (in this case, the second sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor) (Yes in Step S11), after paper detection by the PIN sensor, the control portion 101, using the off-center amount $\alpha 1$ of the prior sheet of paper, calculates $\alpha av=\alpha 1/1$ (Step S21), and based on the result of that calculation $\alpha av$ (in this case, $\alpha 1$ ), determines the correction amount of the position of image writing to the photosensitive drum 14 for the second sheet of paper such that the image writing position of the image information that has been made visible on the photosensitive drum 14 matches the paper transport position of the second sheet of paper (Step S22). Specifically, the correction amount is obtained from $\beta n=\beta 0+\alpha av$. Then, the control portion 101 performs correction of the image writing position based on the correction amount determined in Step S22, and transports the second sheet of paper based on the image writing position after correction in order to perform image forming (print processing) on the second sheet of paper at the image forming position (see nip portion N1), and performs correction of the image writing position based on the correction amount (specifically, correction amount $\beta n=\beta 0+\alpha n-1$) determined in Step S22. The control portion 101 starts print processing for the second sheet of paper based on the image writing position after correction (Step S13).

After print processing is started for the second sheet of paper, that paper is temporarily stopped with the trailing edge of the paper held sandwiched by the pre-registration rollers R41 and R42, and the leading edge of the paper making contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the second sheet of paper with the paper transport position detection portion 70 (CIS sensor configured from the light emitting portion 70*a* and the light receiving portion 70*b* of a line sensor)(Step S11), and this off-center amount $\alpha n(n=2)$ is stored in the memory 104.

After the off-center amount $\alpha n(n=2)$ is stored in the memory 104, the control portion 101 checks whether or not there is subsequent printing (Step S9), and when there is subsequent printing, the control portion 101 feeds the next sheet of paper (in this case, the third sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor) (Yes in Step S11), after paper detection by the PIN sensor, the control portion 101 checks whether or not the number of consecutively transported sheets of paper has exceeded the 30 sheets of one division (Step S31), and when the number of consecutively transported sheets of paper has not exceeded the 30 sheets of one division (when judged No in Step S31), the control portion 101, using all of the offset amounts $\alpha 1$ and $\alpha 2$ up to the previous sheet of paper, calculates $\alpha av=(\alpha 1+\alpha 2)/2$ (Step S21), and based on this average value $\alpha av$, determines the correction amount of the position of image writing to the photosensitive drum 14 for the third sheet of paper such that the image writing position of the image information that has been made visible on the photosensitive drum 14 matches the paper transport position of the third sheet of paper (Step S22). Specifically, the correction amount is obtained from $\beta n=\beta 0+\alpha av$. Then, the control portion 101 performs correction of the image writing position based on the correction amount determined in Step S22, and transports the third sheet of paper based on the image writing position after correction in order to perform image forming (print processing) on the third sheet of paper at the image forming position (see nip portion N1), and performs correction of the image writing position based on the correction amount (specifically, correction amount $\beta n=\beta 0+\alpha n-1$) determined in Step S22. The control portion 101 starts print processing for the third sheet of paper based on the image writing position after correction (Step S13).

After print processing is started for the third sheet of paper, that paper is temporarily stopped with the trailing edge of the paper held sandwiched by the pre-registration rollers R41 and R42, and the leading edge of the paper making contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the third sheet of paper with the paper transport position detection portion 70 (CIS sensor configured from the light emitting portion 70*a* and the light receiving portion 70*b* of a line sensor)(Step S15), and this off-center amount $\alpha n(n=3)$ is stored in the memory 104.

In the manner described above, the control portion 101 repeats the processing of above Steps S9 to S22 to further execute print processing for the fourth and subsequent sheets of paper. Specifically, the control portion 101 executes print processing for the second and subsequent sheets of paper by repeating the processing of above Steps S9 to S22, and in Step S21, by calculating $\alpha av=(\alpha 1+\alpha 2+\ldots+\alpha n-1)/(n-1)$ for each successive sheet of paper using all of the offset amounts $\alpha 1$, $\alpha 2$, . . . , $\alpha n-1$ up to the previous sheet of paper, print processing is executed for the second and subsequent sheets of paper.

EXAMPLE 12

Figure 20:
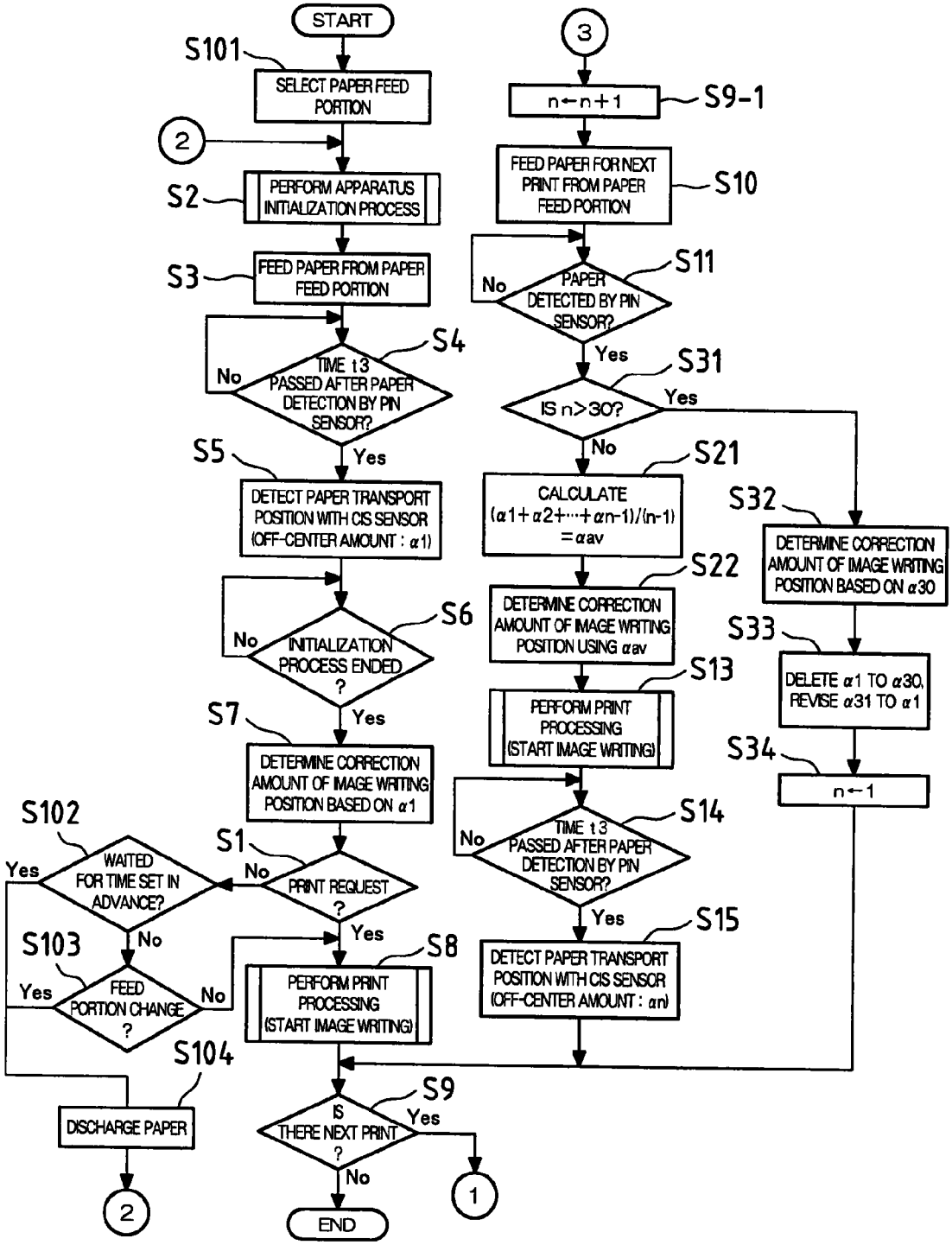
FIG. 20 is a flowchart that illustrates processing to correct an image writing position according to Example 12, and a process of transporting paper to an image position before consecutive print processing.

As shown in FIG. 20, when the image forming apparatus 1 is started up in order to perform image writing, a user performs the above selection of a paper feed portion (Step S101), and the control portion 101 starts the initialization process of the apparatus (with respect to image forming processing) (Step S2). Alternatively, the user performs updating of the paper feed portion (Step S101), and the control portion 101 starts the initialization process of the apparatus (with respect to image forming processing)(Step S2). For example, an apparatus initialization process of, namely, adjusting the charging potential provided by the charging unit 15, or removal of toner stains on the surface of the photosensitive drum 14 by the cleaner 18, is started. Also, in Example 12, in Step S101, the uppermost paper feed cassette 26 shown in FIG. 1 is selected.

Afterward, the control portion 101 transports a sheet of paper from the selected paper feed cassette 26 to the image writing position (Step S3), and transports that sheet of paper in the direction of the photosensitive drum 14 with the transport rollers R31 and R32 via the shared transport path 28, and that paper is stopped with the trailing edge of the paper held sandwiched by the pre-registration rollers R41 and R42, and the leading edge of the paper making contact with the registration rollers R51 and R52. After the paper transported in the direction of the photosensitive drum 14 at this time is detected by the paper detection portion 71 (PIN sensor), the leading edge of the paper arrives at the registration rollers R51 and R52. At this time, when the time t3 passes after paper detection by the paper detection portion 71 (PIN sensor)(when judged Yes in Step S4), the off-center amount $\alpha 1$ is measured by detecting the paper transport position in the paper transport path for the first sheet of paper with the paper transport position detection portion 70 (CIS sensor configured from the light emitting portion 70*a* and the light receiving portion 70*b* of a line sensor)(Step S5), and the off-center amount $\alpha 1$ is stored in the memory 104. As shown in FIG. 7, the off-center amount $\alpha 1$ indicates the distance between the paper transport position $\alpha 0$ at the time of the initial setting and the presently measured paper transport position. In this state, the initialization process of the apparatus ends (Yes in Step S6).

When the initialization process of the apparatus ends, the control portion 101 determines the correction amount of the position of image writing to the photosensitive drum 14 for the first sheet of paper such that the image writing position of the image information that has been made visible on the photosensitive drum 14 matches the paper transport position of the first sheet of paper stopped by the registration rollers R51 and R52, based on the image writing position after correction (based on the off-center amount $\alpha 1$)(Step S7).

After the correction amount of the position of image writing to the photosensitive drum 14 is determined in Step S7, the apparatus waits for a print request for consecutive print processing to a plurality of sheets of paper by operation of the operation panel 10.

In the state waiting for a print request for consecutive print processing to a plurality of sheets of paper, when there is not a print request for consecutive print processing to a plurality of sheets of paper (No in Step S1), the apparatus waits continuously for a print request for a predetermined time (time t8 shown in FIG. 18)(Step S102). When the set time t8 is exceeded, the paper waiting at the image forming position is transported (discharged) to the discharge tray 33 (Step S104), and the apparatus is again initialized (Step S2). When there is a print request before exceeding the set time t8 in Step S102 (time t9 shown in FIG. 17), and also the selected paper feed cassette 26 is changed to another paper feed portion (Yes in Step S103), the paper waiting at the image forming position is transported (discharged) to the discharge tray 33 (Step S104), and the apparatus is again initialized (Step S2). When the paper feed portion is not changed in Step S103, the control portion 101 performs print processing using the selected paper feed cassette 26 (Step S8).

On the other hand, when there is a print request for consecutive print processing to a plurality of sheets of paper in Step S1, the control portion starts print processing using the selected paper feed cassette 26 (Step S8). Specifically, the control portion 101 performs correction of the image writing position based on the correction amount determined above (see FIG. 8), and resumes driving of the registration rollers R51 and R52 and the pre-registration rollers R41 and R42 based on the image writing position after correction to start transport of the first sheet of paper in order to perform image forming (print processing) on the first sheet of paper at the image forming position (see nip portion N1).

At the same time, the control portion 101 checks whether or not there is subsequent printing (Step S9), and when there is subsequent printing, the control portion, after incrementing n indicating the number of transported sheets of paper (Step S9-1), feeds the next sheet of paper (in this case, the second sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor)(Yes in Step S11), after paper detection by the PIN sensor, the control portion 101 checks whether or not the number of consecutively transported sheets of paper has exceeded the 30 sheets of one division (Step S31), and when the number of consecutively transported sheets of paper has not exceeded the 30 sheets of one division (when judged No in Step S31), the control portion 101, using the off-center amount $\alpha 1$ of the prior sheet of paper, calculates $\alpha av=\alpha 1/1$ (Step S21), and based on the result of that calculation $\alpha av$ (in this case, $\alpha 1$), determines the correction amount of the position of image writing to the photosensitive drum 14 for the second sheet of paper such that the image writing position of the image information that has been made visible on the photosensitive drum 14 matches the paper transport position of the second sheet of paper (Step S22). Specifically, the correction amount is obtained from $\beta n=\beta 0+\alpha av$. Then, the control portion 101 performs correction of the image writing position based on the correction amount determined in Step S22, and transports the second sheet of paper based on the image writing position after correction in order to perform image forming (print processing) on the second sheet of paper at the image forming position (see nip portion N1), and performs correction of the image writing position based on the correction amount (specifically, correction amount $\beta n=\beta 0+\alpha n-1$) determined in Step S22. The control portion 101 starts print processing for the second sheet of paper based on the image writing position after correction (Step S13).

After print processing is started for the second sheet of paper, that paper is temporarily stopped with the trailing edge of the paper held sandwiched by the pre-registration rollers R41 and R42, and the leading edge of the paper making contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the second sheet of paper with the paper transport position detection portion 70 (CIS sensor configured from the light emitting portion 70*a* and the light receiving portion 70*b* of a line sensor)(Step S15), and this off-center amount $\alpha n(n=2)$ is stored in the memory 104.

After the off-center amount $\alpha n(n=2)$ is stored in the memory 104, the control portion 101 checks whether or not there is subsequent printing (Step S9), and when there is subsequent printing, the control portion 101 feeds the next sheet of paper (in this case, the third sheet of paper) from the paper feed cassette 26 (Step S10), and transports that sheet of paper in the direction of the photosensitive drum 14 with the transport rollers R31 and R32 via the shared transport path 28. Then, when the paper transported in the direction of the photosensitive drum 14 with the transport rollers R31 and R32 is detected by the paper detection portion 71 (PIN sensor) (Yes in Step S11), after paper detection by the PIN sensor, the control portion 101 checks whether or not the number of consecutively transported sheets of paper has exceeded the 30 sheets of one division (Step S31), and when the number of consecutively transported sheets of paper has not exceeded the 30 sheets of one division (when judged No in Step S31), the control portion 101, using all of the offset amounts $\alpha 1$ and $\alpha 2$ up to the previous sheet of paper, calculates $\alpha av=(\alpha 1+\alpha 2)/2$ (Step S21), and based on this average value $\alpha av$, determines the correction amount of the position of image writing to the photosensitive drum 14 for the third sheet of paper such that the image writing position of the image information that has been made visible on the photosensitive drum 14 matches the paper transport position of the third sheet of paper (Step S22). Specifically, the correction amount is obtained from $\beta n=\beta 0+\alpha av$. Then, the control portion 101 performs correction of the image writing position based on the correction amount determined in Step S22, and transports the third sheet of paper based on the image writing position after correction in order to perform image forming (print processing) on the third sheet of paper at the image forming position (see nip portion N1), and performs correction of the image writing position based on the correction amount (specifically, correction amount $\beta n=\beta 0+\alpha n-1$) determined in Step S22. The control portion 101 starts print processing for the third sheet of paper based on the image writing position after correction (Step S13).

After print processing is started for the third sheet of paper, that paper is temporarily stopped with the trailing edge of the paper held sandwiched by the pre-registration rollers R41 and R42, and the leading edge of the paper making contact with the registration rollers R51 and R52. At this time, when the time t3 passes after paper detection by the paper detection portion 71 (PIN sensor)(when judged Yes in Step S14), the paper transport position is detected by measuring the off-center amount in the paper transport path for the third sheet of paper with the paper transport position detection portion 70 (CIS sensor configured from the light emitting portion 70*a* and the light receiving portion 70*b* of a line sensor)(Step S15), and this off-center amount $\alpha n(n=3)$ is stored in the memory 104.

In the manner described above, the control portion 101 repeats the processing of above Steps S9 to S31 to further execute print processing for the fourth and subsequent sheets of paper. Specifically, the control portion 101 executes print processing for the second and subsequent sheets of paper by repeating the processing of above Steps S9 to S31, and in Step S21, by calculating $\alpha av=(\alpha 1+\alpha 2+\ldots+\alpha n-1)/(n-1)$ for each successive sheet of paper using all of the offset amounts $\alpha 1$, $\alpha 2$, . . . , $\alpha n-1$ up to the previous sheet of paper, print processing is executed for the second and subsequent sheets of paper. When, in such repetition of the processing of Steps S9 to S31, the control portion 101 has confirmed that the number of consecutively transported sheets of paper has exceeded the 30 sheets of one division (when judged Yes in Step S31), i.e., in the case of the 31st consecutively transported sheet of paper, the control portion 101, based on the detection value $\alpha 30$ for the immediately previous 30th sheet of paper, determines the correction amount of the position of image writing to the photosensitive drum 14 for the 31st sheet of paper such that the image writing position of the image information that has been made visible on the photosensitive drum 14 matches the leading edge of the paper stopped by the registration rollers R51 and R52 (Step S32). Specifically, the correction amount is obtained from $\beta 31=\beta 0+\alpha 30$. That is, the processing in Step S32 treats the 31st sheet in actuality as the first sheet of a new division, and in that sense is the same as the processing in Step S6. Also note that in the present example, 30 sheets of paper is used as one division of the consecutively transported paper, but the fixed number of sheets is not limited to 30 sheets; the fixed number of sheets may be set as desired.

Afterward, the past history $\alpha 1$ to $\alpha 30$ stored in the memory 104 is deleted (Step S33), and after changing the symbol of the presently stored off-center amount $\alpha 31$ to $\alpha 1$ (that is, after changing only the symbol and retaining the detection value as-is), n indicating the number of transported sheets of paper is initialized to 1 (Step S34), and processing returns to Step S9. Thus, the correction amount of the position for image writing to the photosensitive drum 14 is sequentially determined for the next division of 30 pages in the same manner as for the previous division of 30 pages.

In above Embodiments 1 and 2 (including Examples 1 to 12), the correction amount of the image writing position is determined based on the off-center amount in the paper transport path, but this is not a limitation; the correction amount of the image writing position may also be determined based on the displacement amount in the paper transport direction. Also, the correction amount of the image writing position may be determined based on the off-center amount in the paper transport path and the displacement amount in the paper transport direction. Also, according to another embodiment of the correction of the image writing position, an off-center position in the paper transport path and displacement in the paper transport direction are corrected, but this is not a limitation; correction of the paper transport timing may also be performed in addition to correction of the paper transport direction in the paper transport path.

Also, in above Embodiments 1 and 2 (including Examples 1 to 12), the paper transport position detection portion 70 performs detection of the paper transport position in a state with the paper stopped by the registration rollers R51 and R52, but this is not a limitation. In another embodiment given by way of example, the paper transport position detection portion 70 performs detection of the paper transport position in a state in which the paper is transported by the registration rollers R51 and R52. Specifically, the paper transport position detection portion 70 may perform detection of the paper transport position from a state in which the paper has been stopped by the registration rollers R51 and R52, and until transport by the registration rollers R51 and R52 ends. Also, the paper transport position detection portion 70 may detect the edge of the paper on a side in the direction perpendicular to the transport direction. In this case, it is possible to detect the paper transport position in a state in which bowing of the paper in the paper transport path, which occurs due to holding the paper sandwiched (with transport stopped) by the registration rollers R51 and R52 and the pre-registration rollers R41 and R42, is eliminated, and so displacement of the paper transport position due to bowing of the paper can be suppressed.

Figure 21:
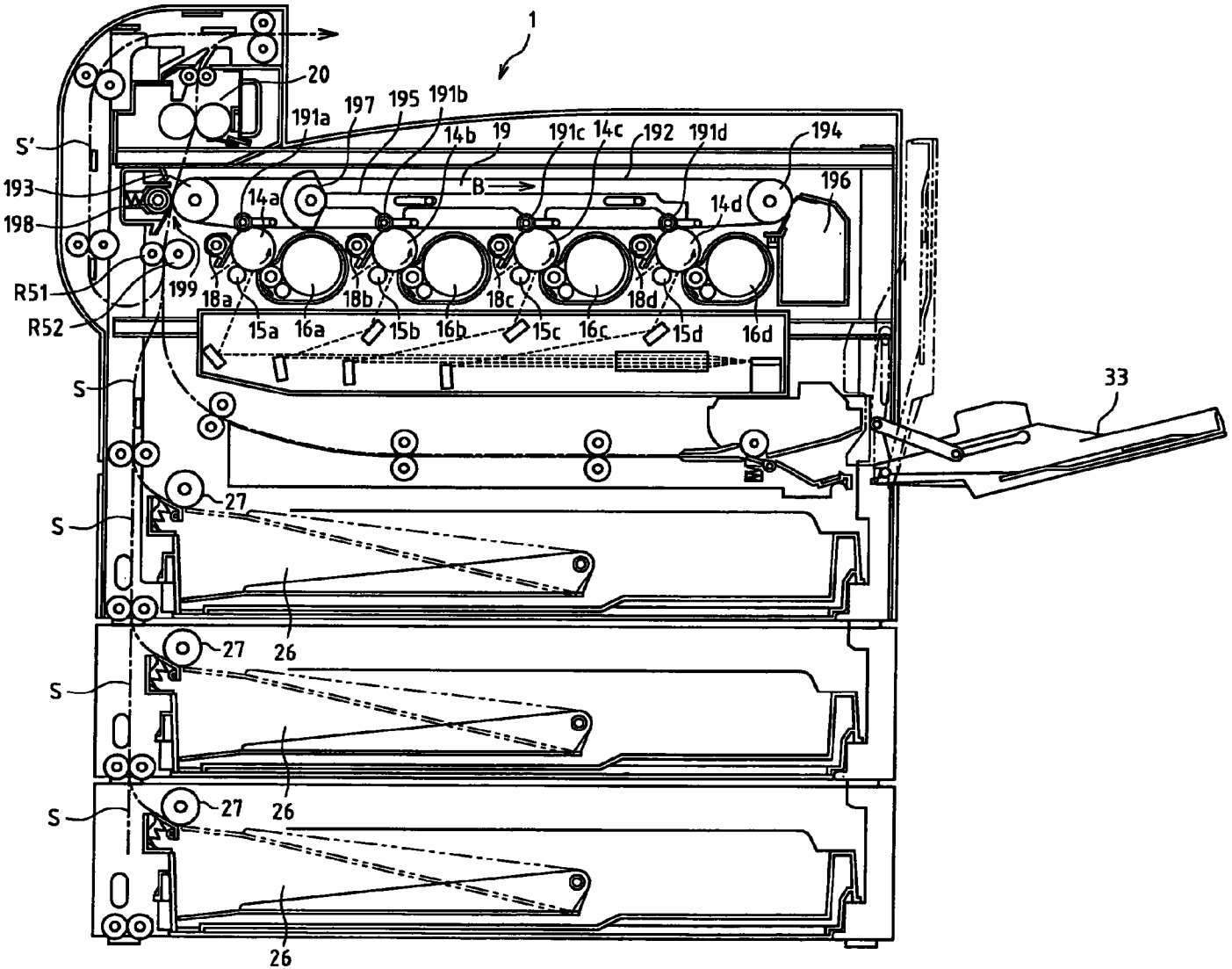
FIG. 21 is a schematic configuration view that shows the overall configuration of an intermediate transfer-type image forming apparatus according to the present embodiment.

Also, in above Embodiments 1 and 2 (including Examples 1 to 12), a direct transfer-type image forming apparatus 1 is used, but this is not a limitation; the image forming apparatus 1 may also be a color tandem-type image forming apparatus (intermediate transfer-type) such as that shown in FIG. 21, which forms a color or monochrome image on paper using a plurality of photosensitive drums.

The direct transfer-type image forming apparatus 1 and an intermediate transfer-type image forming apparatus have the following points in common. In the above direct transfer-type image forming apparatus 1, the timing of image writing to the photosensitive drum 14 (image carrier) is related to the transfer timing for directly transferring image information from the photosensitive drum 14 to form an image on paper (see FIGS. 9, 17, and 18). On the other hand, in the case of an intermediate transfer-type image forming apparatus, the timing for image writing to a photosensitive drum performed first among a plurality of photosensitive drums is related to the transfer timing for indirectly transferring image information from the photosensitive drum 14 to an intermediate transfer belt (image carrier) in order to indirectly form the image information on paper. That is, in the case of the direct transfer-type image forming apparatus 1 according to this embodiment, there is a relationship between the photosensitive drum and the paper, and in the case of an intermediate transfer-type image forming apparatus, there is a relationship between the photosensitive drum to which image writing is performed first and the intermediate transfer belt, so these configurations differ only in whether transfer is performed to the paper or to the intermediate transfer belt. Accordingly, when an intermediate transfer-type image forming apparatus is adopted in the present invention, at least, when performing consecutive print processing to a plurality of sheets of paper, the paper transport position in the paper transport path is detected by the paper transport position detection portion for a sheet of paper that has been set in advance among the plurality of sheets of paper, a correction amount of the position of image writing to the photosensitive drum to which image writing is first performed is determined based on the detected paper transport position, correction of the image writing position is performed based on the correction amount, image forming on paper is performed indirectly via the intermediate transfer belt at the image forming position based on the image writing position after correction, and image forming on other paper is performed indirectly via the intermediate transfer belt at the image forming position based on the image writing position after correction is performed with respect to that other paper. With this intermediate transfer-type image forming apparatus, the same working effects are obtained as in the embodiments above.

Following is a general description of the intermediate transfer-type image forming apparatus shown in FIG. 21. In this description, aspects of the image forming system that differ from those in the above direct transfer-type image forming apparatus 1 according to the present embodiment are described, while aspects of the configuration that are the same are denoted by the same reference numerals and omitted from the present description.

The configuration of the image forming system of the intermediate transfer-type image forming apparatus shown in FIG. 21 includes a development unit 16, a photosensitive drum 14, a cleaner 18, a charging unit 15, an intermediate transfer belt unit 19, a fixing unit 20, and the like. The image forming apparatus 1 forms a color or monochrome image on a predetermined paper P (recording sheet) according to image data transmitted from outside. As described below, the image forming apparatus 1 is configured as a color image forming apparatus employing an intermediate transfer method, in which a color image is formed on the paper P by, using a plurality (four in this example) of the photosensitive drums 14, transferring image information color-separated into a plurality of colors (four colors in this example) in layers onto an intermediate transfer belt 192 (see below) that rotates in contact with each of the photosensitive drums 14 at a predetermined pressure, and then that image information is collectively transferred to the paper P, which is transported from a paper feed cassette 10 or a manual tray 20, described below.

Image data handled in the image forming apparatus 1 corresponds to a color image using the colors black (K), cyan (C), magenta (M), and yellow (Y). Accordingly, four sensitive drums 14 (14*a*, 14*b*, 14*c*, and 14*d*), four charging units 15 (15*a*, 15*b*, 15*c*, and 15*d*), four development units 16 (16*a*, 16*b*, 16*c*, and 16*d*), and four cleaners 18 (18*a*, 18*b*, 18*c*, and 18*d*) are provided so as to form four types of latent images corresponding to each color (K, C, M, Y), thus forming four image stations (image forming portions) in the image forming apparatus 1. Here, the constituent portions with the appended letter a correspond to black, the constituent portions with the appended letter b correspond to cyan, the constituent portions with the appended letter c correspond to magenta, and the constituent portions with the appended letter d correspond to yellow. Also, as shown in FIG. 21, of the four image forming stations, the image station disposed at the farthest position relative to a transport path S is image station for yellow.

The intermediate transfer belt unit 19 forms a color image on the paper P using an intermediate transfer method, and is provided with intermediate transfer rollers 191 (191*a*, 191*b*, 191*c*, and 191*d*), the intermediate transfer belt 192, an intermediate transfer belt drive roller 193, an intermediate transfer belt idler roller 194, an intermediate transfer belt tension mechanism 195, and an intermediate transfer belt cleaning unit 196.

The intermediate transfer belt 192 is stretched across the intermediate transfer belt drive roller 193, an intermediate transfer belt tension roller 197 of the intermediate transfer belt tension mechanism 195, the intermediate transfer rollers 191, the intermediate transfer belt idler roller 194, and the like, and is rotationally driven in the direction of arrow B. In this example, the intermediate transfer belt 192 is formed endlessly using a film with a thickness of about 100 to 150 μm. Also, the intermediate transfer belt 192 is provided so as to be sandwiched by each of the photosensitive drums 14 and the intermediate transfer rollers 191. By transferring, sequentially overlaid, toner images that have been formed on each of the photosensitive drums 14, a color toner image is formed on the intermediate transfer belt 192.

Transfer of toner images from the photosensitive drums 14 to the intermediate transfer belt 192 is performed by the intermediate transfer rollers 191 in contact with the back side of the intermediate transfer belt 192. The intermediate transfer belt rollers are rotatably supported by intermediate transfer roller installation portions of the intermediate transfer belt tension mechanism 195. In order to transfer the toner images of the photosensitive drums 14 onto the intermediate transfer belt 192, a high voltage transfer bias (high voltage with a polarity (+) opposite to the charging polarity (−) of the toner) is applied to the intermediate transfer rollers 191.

The intermediate transfer rollers 191 use a metal shaft (for example, stainless steel or the like) with a diameter of 8 to 10 mm as a base, with the surface of that shaft being covered with electrically conductive elastic material (for example, such as EPDM or urethane foam). With this electrically conductive elastic material, it is possible to uniformly apply a high voltage to the intermediate transfer belt 192. In this example, roller-like transfer electrodes are used, but brush-like transfer electrodes may also be used.

As described above, the input image information is made visible on each photosensitive drum 14 corresponding to each color, and transferred in layers onto the intermediate transfer belt 192. The layered image information is collectively transferred (secondary transfer) onto the paper P at a secondary transfer portion 199 where the intermediate transfer belt 192 and a secondary transfer roller 198 press against each other. At this time, the intermediate transfer belt 192 and the secondary transfer roller 198 press against each other at the secondary transfer portion 199 with a predetermined nip, and a voltage for transferring the color toner images layered on the intermediate transfer belt 192 to the paper P (high voltage with a polarity (+) opposite to the charging polarity (−) of the toner) is applied to the secondary transfer roller 198. A roller of hard material (for example, such as metal) is used for one of the secondary transfer roller 198 and the intermediate transfer belt drive roller 193, and for the other, an elastic roller of a soft material (for example, rubber, foam resin, or the like) is used, so that the above nip is constantly obtained.

The present invention may be embodied in various other forms without departing from the gist or essential characteristics thereof The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

Also, an image forming apparatus according to the present invention is applicable to high speed digital compound machines that have copy, printer, scanner, and facsimile modes, and perform high speed print processing of a large quantity of prints.

What is claimed is:

1. An image forming apparatus that forms an image on paper, the image forming apparatus comprising:

an image carrier that forms an image on paper at an image forming position provided in a paper transport path where paper is transported, a registration roller that performs transport and transport stoppage of paper to the image forming position, and a paper transport position detection portion that detects a paper transport position of paper in the paper transport path; wherein the registration roller is provided upstream in the paper transport path from the image forming position, and the paper transport position detection portion is provided upstream in the paper transport path from the registration roller, and when performing consecutive print processing to a plurality of sheets of paper, the paper transport position in the paper transport path is detected by the paper transport position detection portion for a sheet of paper that has been set in advance among the plurality of sheets of paper, a correction amount of the position of image writing to the image carrier is determined based on the detected paper transport position, correction of the image writing position is performed based on the correction amount, image forming on paper is performed at the image forming position based on the image writing position after the correction, and image forming on other sheets of paper after the sheet of paper that was set in advance is performed at the image forming position based on the image writing position after the correction.

2. The image forming apparatus according to claim 1, wherein image forming is performed directly on paper by the image carrier at the image forming position based on the image writing position after the correction, and image forming on other sheets of paper after the sheet of paper that was set in advance is performed directly by the image carrier at the image forming position based on the image writing position after the correction.

3. The image forming apparatus according to claim 1, wherein image forming is performed indirectly on paper by the image carrier at the image forming position based on the image writing position after the correction, and image forming on other sheets of paper after the sheet of paper that was set in advance is performed indirectly by the image carrier at the image forming position based on the image writing position after the correction.

4. The image forming apparatus according to claim 1, wherein the correction amount of the image writing position is determined based on a displacement amount of the paper transport position of paper detected by the paper transport position detection portion relative to a paper transport position that has been set in advance in the paper transport path.

5. The image forming apparatus according to claim 4, wherein the displacement amount is an off-center amount of the paper transport position of paper in a direction perpendicular to the transport direction in the paper transport path, and when performing consecutive print processing to a plurality of sheets of paper, the off-center amount in the paper transport path is measured by the paper transport position detection portion for the sheet of paper that has been set in advance, a correction amount of the position of image writing to the image carrier is determined based on the detected off-center amount, correction of the image writing position is performed based on the correction amount, image forming on paper is performed at the image forming position based on the image writing position after the correction, and image forming on the other paper is performed at the image forming position based on the image writing position after the correction.

6. The image forming apparatus according to claim 1, wherein a plurality of paper feed portions that transport paper to the image forming position are provided upstream in the paper transport path from the registration roller, and correction of the image writing position is performed independently for each of the plurality of paper feed portions.

7. The image forming apparatus according to claim 6, wherein when the paper feed portion has been changed when performing consecutive print processing to a plurality of sheets of paper, image forming processing of the apparatus is initialized, and correction of the image writing position of paper transported from the paper feed portion is performed for the paper feed portion after the change.

8. The image forming apparatus according to claim 6. wherein when the paper feed portion has been updated when performing consecutive print processing to a plurality of sheets of paper, image forming processing of the apparatus is initialized, and correction of the image writing position of paper transported from the paper feed portion is performed for the updated paper feed portion.

9. The image forming apparatus according to claim 6, wherein the correction amount of the image writing position is measured for a plurality of sheets of paper that have been set in advance, transported from the same paper feed portion, and an average value of the correction amount of the plurality of sheets or of paper is used as the correction value of the image writing position.

10. The image forming apparatus according to claim 9, wherein the correction value of the image writing position is limited to a correction value within a range that has been set in advance, and a correction value outside of the range that has been set in advance is excluded from data for the average value.

11. The image forming apparatus according to claim 1, wherein the paper transport position detection portion performs detection of the paper transport position in a state with paper stopped by the registration roller.

12. The image forming apparatus according to claim 1, wherein the paper transport position detection portion performs detection of the paper transport position in a state in which paper is transported by the registration roller.

13. The image forming apparatus according to claim 12, wherein the paper transport position detection portion performs detection of the paper transport position from a state in which the paper has been stopped by the registration roller, until paper transport by the registration roller ends.

14. The image forming apparatus according to claim 12, wherein the paper transport position detection portion detects the edge of paper on a side in the direction perpendicular to the transport direction of the paper.

15. The image forming apparatus according to claim 1, wherein a plurality of paper feed portions that transport paper to the image forming position are provided upstream in the paper transport path from the registration roller, and prior to consecutive print processing of a plurality of sheets of paper transported to the image forming position from a paper feed portion selected from among the plurality of paper feed portions in order to perform image writing, paper is transported from the selected paper feed portion to the image forming position.

16. The image forming apparatus according to claim 15, wherein when the paper feed portion has been updated, paper is transported to the image writing position from the updated paper feed portion prior to the consecutive print processing.

17. The image forming apparatus according to claim 15, wherein when the paper feed portion has been changed, paper transported to the image writing position prior to the consecutive print processing is transported out of the image forming position.

18. The image forming apparatus according to claim 15, wherein after passage of a time set in advance, paper transported to the image writing position prior to the consecutive print processing is transported out of the image forming position.

19. The image forming apparatus according to claim 2, wherein the correction amount of the image writing position is determined based on a displacement amount of the paper transport position of paper detected by the paper transport position detection portion relative to a paper transport position that has been set in advance in the paper transport path.

20. The image forming apparatus according to claim 3, wherein the correction amount of the image writing position is determined based on a displacement amount of the paper transport position of paper detected by the paper transport position detection portion relative to a paper transport position that has been set in advance in the paper transport path.

* * * * *